US010294942B2

(12) United States Patent
Toyama

(10) Patent No.: US 10,294,942 B2
(45) Date of Patent: May 21, 2019

(54) COMPRESSOR

(71) Applicant: DAIKIN INDUSTRIES, LTD., Osaka-shi, Osaka (JP)

(72) Inventor: Toshiyuki Toyama, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 39 days.

(21) Appl. No.: 15/534,937

(22) PCT Filed: Dec. 11, 2015

(86) PCT No.: PCT/JP2015/084859
§ 371 (c)(1),
(2) Date: Jun. 9, 2017

(87) PCT Pub. No.: WO2016/093361
PCT Pub. Date: Jun. 16, 2016

(65) Prior Publication Data

US 2018/0223850 A1 Aug. 9, 2018

(30) Foreign Application Priority Data

Dec. 12, 2014 (JP) ..... 2014-252520
Dec. 12, 2014 (JP) ..... 2014-252521
Dec. 12, 2014 (JP) ..... 2014-252522

(51) Int. Cl.
*F04B 39/02* (2006.01)
*F04C 11/00* (2006.01)
(Continued)

(52) U.S. Cl.
CPC ..... *F04C 29/021* (2013.01); *F04B 39/02* (2013.01); *F04B 39/0261* (2013.01);
(Continued)

(58) Field of Classification Search
CPC ..... F04C 29/021; F04C 29/0085; F04C 29/0057; F04C 29/025; F04C 29/023;
(Continued)

(56) References Cited

U.S. PATENT DOCUMENTS 4,502,852 A * 3/1985 Hazaki ..... F01C 21/04 418/55.6
5,375,986 A * 12/1994 Ukai ..... F04C 2/04 418/235
(Continued)

FOREIGN PATENT DOCUMENTS

JP 57-173503 A 10/1982
JP 6-10864 A 1/1994
(Continued)

OTHER PUBLICATIONS

International Search Report of corresponding PCT Application No. PCT/JP2015/084859 dated Mar. 8, 2016.
(Continued)

*Primary Examiner* — Nathan C Zollinger
(74) *Attorney, Agent, or Firm* — Global IP Counselors, LLP

(57) ABSTRACT

A compressor includes a casing with an oil retention space, an electric motor, a driveshaft, a compression mechanism, an oil supply passage, an oil discharge passage, an oil supply pump, and an oil discharge pump. The compression mechanism has a movable part, and an upper housing forming a crank chamber. The upper housing has an upper bearing that pivotally supports the driveshaft below the crank chamber. The oil supply passage leads oil in the oil retention space to the crank chamber. The oil discharge passage includes a main oil discharge passage, and a first inflow passage communicating between the main oil discharge passage and the crank chamber. An oil-recovery space is formed in a lower part of the upper housing below the crank chamber.
(Continued)

The oil discharge passage includes a second inflow passage communicating between the main oil discharge passage and the oil-recovery space.

14 Claims, 12 Drawing Sheets

(51) Int. Cl.

| | |
|---|---|
| ***F04C 18/02*** | (2006.01) |
| ***F04C 29/00*** | (2006.01) |
| ***F04C 29/02*** | (2006.01) |
| ***F04C 27/00*** | (2006.01) |
| *F04C 23/00* | (2006.01) |

(52) U.S. Cl.
CPC ..... *F04C 18/0215* (2013.01); *F04C 27/009* (2013.01); *F04C 29/0057* (2013.01); *F04C 29/0085* (2013.01); *F04C 29/023* (2013.01); *F04C 29/025* (2013.01); *F04C 11/003* (2013.01); *F04C 23/008* (2013.01); *F04C 2240/603* (2013.01); *F04C 2240/807* (2013.01)

(58) Field of Classification Search
CPC ..... F04C 18/0215; F04C 27/009; F04C 2240/603; F04C 2240/807; F04C 11/003; F04C 23/008; F04B 39/02
See application file for complete search history.

(56) References Cited

U.S. PATENT DOCUMENTS

| | | | | |
|---|---|---|---|---|
| 6,135,738 | A * | 10/2000 | Kajiwara | F04C 18/0215 418/188 |
| 7,214,044 | B2 * | 5/2007 | Uekawa | F04C 29/023 184/6.18 |
| 7,645,129 | B2 * | 1/2010 | Kim | F04C 18/0215 418/47 |
| 8,342,827 | B2 * | 1/2013 | Cho | F01C 21/007 417/390 |
| 9,850,904 | B2 * | 12/2017 | Toyama | F04C 23/008 |
| 2002/0033305 | A1 * | 3/2002 | Koyama | F16N 7/36 184/6.16 |
| 2007/0122303 | A1 * | 5/2007 | Kim | F04C 15/0049 418/55.6 |
| 2015/0030487 | A1 | 1/2015 | Toyama et al. | |
| 2016/0208803 | A1 * | 7/2016 | Uekawa | F04C 29/0057 |

FOREIGN PATENT DOCUMENTS

| | | | |
|---|---|---|---|
| JP | 6-66275 | A | 3/1994 |
| JP | 2000-80993 | A | 3/2000 |
| JP | 2001-3867 | A | 1/2001 |
| JP | 2009-36136 | A | 2/2009 |
| JP | 2013-137002 | A | 7/2013 |
| JP | 2013-177877 | A | 9/2013 |
| JP | 2014-199017 | A | 10/2014 |
| JP | 2015-34473 | A | 2/2015 |

OTHER PUBLICATIONS

European Search Report of corresponding EP Application No. 15 86 6658.6 dated Oct. 6, 2017.
International Preliminary Report of corresponding PCT Application No. PCT/JP2015/084659 dated Jun. 22, 2017.

* cited by examiner

COMPRESSOR

CROSS-REFERENCE TO RELATED APPLICATIONS

This U.S. National stage application claims priority under 35 U.S.C. § 119(a) to Japanese Patent Application Nos. 2014-252520, filed in Japan on Dec. 12, 2014, 2014-252521, filed in Japan on Dec. 12, 2014, and 2014-252522, filed in Japan on Dec. 12, 2014, the entire contents of which are hereby incorporated herein by reference.

TECHNICAL FIELD

The present invention relates to a compressor, and, more specifically, to a compressor in which an oil discharge passage for discharging oil that has collected in a crank chamber is formed in a driveshaft.

BACKGROUND ART

In the prior art, as for example described in Japanese Laid-open Patent Publication No. 2013-177877, compressors are known in which, in order to supply oil for lubrication to sliding parts, an oil supply passage in which oil in an oil retention space at the bottom part of a casing travels to a crank chamber in which an eccentric part of the driveshaft is accommodated, and an oil discharge passage for returning oil that has collected in the crank chamber to the oil retention space are formed in the driveshaft. In the compressor of Japanese Laid-open Patent Publication No. 2013-177877, the oil discharge passage includes a main passage that extends in the axial direction in the driveshaft, and an inflow passage that extends from the main passage in a direction intersecting the axial direction and opens into the crank chamber.

SUMMARY

Technical Problem

The inventor of the present invention discovered that, in a compressor with a configuration such as that in Japanese Laid-open Patent Publication No. 2013-177877, oil is not readily led into an intake hole due to the centrifugal force caused by rotation of the driveshaft, and oil tends to collect in the crank chamber. If too much oil collects in the crank chamber, the pressure in the crank chamber will rise, and it is therefore likely that the efficiency of the compressor will be decreased due to increased power of the oil supply pump. Further, as the pressure in the crank chamber rises, there is a possibility that oil leaks from the lower part of the housing in which the crank chamber is formed, and oil loss, in which oil flows out from the compressor, tends to be caused.

An object of the present invention is to provide a compressor in which an oil discharge passage for discharging oil from the crank chamber is formed in the driveshaft, wherein it is possible to prevent a state in which oil collects in the crank chamber, and the pressure in the crank chamber rises excessively.

Solution to Problem

A compressor according to a first aspect of the present invention is provided with a casing, an electric motor, a driveshaft, a compression mechanism, an oil supply passage, an oil discharge passage, an oil supply pump, and an oil discharge pump. An oil retention space is formed in a bottom part of the casing. The electric motor is accommodated in the casing. The driveshaft extends in the vertical direction and is connected to the electric motor. The compression mechanism is accommodated in the casing, and has a movable part and an upper housing. The movable part is connected to the driveshaft and is driven by the electric motor. The upper housing forms a crank chamber which internally accommodates a connecting portion that connects an eccentric part of the driveshaft and the movable part. The upper housing has an upper bearing that pivotally supports the driveshaft below the crank chamber. The oil supply passage leads oil in the oil retention space to the crank chamber. The oil supply passage is formed in the driveshaft. The oil discharge passage includes a main oil discharge passage and a first inflow passage. The main oil discharge passage extends in an axial direction in the driveshaft. The first inflow passage communicates between the main oil discharge passage and the crank chamber. The oil supply pump supplies oil in the oil retention space to the oil supply passage. The oil discharge pump discharges oil in the crank chamber to the oil retention space via the oil discharge passage. An oil-recovery space is formed in a lower part of the upper housing, below the crank chamber. The oil discharge passage further includes a second inflow passage communicating between the main oil discharge passage and the oil-recovery space.

In the compressor according to the first aspect of the present invention, the oil discharge passage has, in addition to the first inflow passage that communicates with the crank chamber, a second inflow passage that communicates with the oil-recovery space, which is formed below the crank chamber in the lower part of the upper housing. Accordingly, the amount of oil that flows into the main oil discharge passage can be increased, and it is therefore possible to prevent that oil is collected in the crank chamber and pressure therein rises excessively.

A compressor according to a second aspect of the present invention is the compressor according to the first aspect, in which the oil-recovery space is formed below the upper bearing.

In the compressor according to the second aspect of the present invention, oil that has reached to below the upper bearing and might leak out from the lower part of the upper housing can be led to the oil retention space via the oil discharge passage, and the occurrence of oil loss due to oil that has leaked from the lower part of the upper housing can be prevented.

A compressor according to a third aspect of the present invention is the compressor according to the first aspect or the second aspect, in which the upper housing further has an upper shaft seal part that is disposed below the oil-recovery space. The compressor is further provided with an upper shaft seal ring that is disposed at the upper shaft seal part.

In the compressor according to the third aspect of the present invention, an upper shaft seal ring is disposed at the upper shaft seal part below the oil-recovery space, so that even if the pressure in the crank chamber has risen, leakage of oil from the lower part of the upper housing can be prevented, and oil loss can be suppressed.

A compressor according to a fourth aspect of the present invention is the compressor according to the third aspect, and is further provided with a lower housing and a lower shaft seal ring. The lower housing has a lower bearing and a lower shaft seal part. The lower bearing pivotally supports the driveshaft. The lower shaft seal part is disposed above the lower bearing. The lower shaft seal ring is disposed at the lower shaft seal part.

In the compressor according to the fourth aspect of the present invention, the lower shaft seal ring is disposed at the lower shaft seal part of the lower housing, and therefore leakage of oil from the upper part of the lower housing can be prevented, and oil loss can be suppressed more easily.

A compressor according to a fifth aspect of the present invention is the compressor according to the fourth aspect, in which an annular space is disposed below the lower shaft seal part. The annular space is formed so as to surround the driveshaft. The annular space communicates with the main oil discharge passage. An oil passage which communicates between the annular space and the oil retention space is formed in the lower housing.

In the compressor according to the fifth aspect of the present invention, by providing an annular space and an oil passage, a passage in which oil flows from the main oil discharge passage to the oil retention space can be easily secured. Accordingly, a rise in the pressure of the crank chamber can be suppressed to be comparatively low, and oil loss due to leakage of oil from the lower part of the upper housing can be suppressed.

A compressor according to a sixth aspect of the present invention is the compressor according to the fourth aspect or the fifth aspect, in which a groove, in which the lower shaft seal ring is disposed, is formed on the driveshaft.

In the compressor according to the sixth aspect of the present invention, a groove in which the lower shaft seal ring is disposed is provided on the driveshaft, and therefore a compressor in which a lower shaft seal ring is disposed at the lower shaft seal part can easily be assembled.

A compressor according to a seventh aspect of the present invention is the compressor according to any one among the third aspect to the sixth aspect, in which a groove, in which the upper shaft seal ring is disposed, is formed on the driveshaft.

In the compressor as in the seventh aspect of the present invention, a groove in which the upper shaft seal ring is disposed is provided on the driveshaft, and therefore a compressor in which an upper shaft seal ring is disposed at the upper shaft seal part can easily be assembled.

A compressor according to an eighth aspect of the present invention is the compressor according to any one among the first aspect to the seventh aspect, in which the discharge rate of the oil discharge pump is larger than the discharge rate of the oil supply pump.

In the compressor according to the eighth aspect of the present invention, the discharge rate of the oil discharge pump which discharges oil from the crank chamber is larger than the discharge rate of the oil supply pump which transports oil to the crank chamber, and therefore oil in the crank chamber can easily be discharged through the oil discharge passage. Accordingly, surplus collection of oil in the crank chamber can be prevented. As a result, a rise in pressure in the crank chamber can be suppressed, and a drop in efficiency of the compressor due to increased power of the oil supply pump can be prevented.

A compressor according to a ninth aspect of the present invention is the compressor according to the eighth aspect, in which the oil discharge pump and the oil supply pump are positive displacement pumps. The capacity of the oil discharge pump is larger than the capacity of the oil supply pump.

In the compressor according to the ninth aspect of the present invention, since the capacity of the oil discharge pump is larger than the capacity of the oil supply pump, the amount of oil flowing into the main oil discharge passage can be increased, and excessive collection of oil in the crank chamber can be prevented. As a result, a rise in the pressure of the crank chamber can be suppressed to be comparatively low.

A compressor according to the tenth aspect of the present invention is the compressor according to the eighth aspect or the ninth aspect, in which the oil discharge pump and the oil supply pump are connected to a lower part of the driveshaft to configure a double pump.

In the compressor according to the tenth aspect of the present invention, since the oil discharge pump and the oil supply pump configure a double pump, the mechanism for supplying/discharging oil can be made compact, and the compressor thereby can be made compact.

A compressor according to an eleventh aspect of the present invention is the compressor according to any one among the first aspect to the tenth aspect, in which an area of the inflow passage inlet of the first inflow passage that opens into the crank chamber is larger than an area of the inflow passage outlet of the first inflow passage that opens into the main oil discharge passage. The inflow passage inlet is deflected forward in the rotation direction of the driveshaft than the inflow passage outlet.

In the compressor according to the eleventh aspect of the present invention, the area of the inflow passage inlet is formed to be larger than the area of the inflow passage outlet, and moreover the inflow passage inlet is shifted toward the forward side in the rotation direction of the driveshaft, and therefore oil is easily guided into the first inflow passage, and oil in the crank chamber is easily discharged through the oil discharge passage. Accordingly, an excessive rise in pressure due to surplus oil collection in the crank chamber can be prevented.

A compressor according to a twelfth aspect of the present invention is the compressor according to the eleventh aspect, in which the first inflow passage has an outlet-vicinity part that includes a straight part that extends, in plan view, in a first direction from the inflow passage outlet. In plan view, a centroid of the inflow passage inlet is positioned on the forward side in the rotation direction relative to a first reference straight line that extends in the first direction from a centroid of the inflow passage outlet.

In the compressor according to the twelfth aspect of the present invention, in plan view, the centroid of the inflow passage input is disposed on the forward side in the rotation direction of the driveshaft relative to the first reference straight line, and therefore the inflow passage inlet is deflected forward in the rotation direction of the driveshaft than the inflow passage outlet. Accordingly, oil in the crank chamber is more easily discharged through the oil discharge passage, and surplus oil collection in the crank chamber can be prevented.

A compressor according to a thirteenth aspect of the present invention is the compressor according to the eleventh aspect, in which, in plan view, a centroid of the inflow passage inlet is positioned on the forward side in the rotation direction relative to a second reference straight line that extends from the rotation center of the driveshaft through a centroid of the inflow passage outlet.

In the compressor according to the thirteenth aspect of the present invention, in plan view, the centroid of the inflow passage inlet is disposed on the forward side in the rotation direction of the driveshaft relative to the second reference straight line, and therefore the inflow passage inlet is deflected forward in the rotation direction of the driveshaft than the inflow passage outlet. Accordingly, oil in the crank chamber is more easily discharged through the oil discharge passage, and surplus oil collection in the crank chamber can be prevented.

A compressor according to a fourteenth aspect of the present invention is the compressor according to any one among the eleventh aspect to the thirteenth aspect, and is further provided with a balance weight that is installed to the driveshaft in the crank chamber. The first inflow passage includes an in-shaft inflow passage formed in the driveshaft and an in-weight inflow passage formed in the balance weight. The in-weight inflow passage communicates with the in-shaft inflow passage and opens into the crank chamber.

In the compressor according to the fourteenth aspect of the present invention, the in-weight inflow passage opens into the crank chamber, and an inflow passage inlet is provided in the balance weight. Therefore, it is possible to secure a large area for the inflow passage inlet without reducing the strength of the driveshaft.

A compressor according to a fifteenth aspect of the present invention is the compressor according to the thirteenth aspect, in which the first inflow passage has a guide surface that extends in a direction intersecting the rotation direction. In plan view, the guide surface is parallel to the second reference straight line, or is deflected forward in the rotation direction than the second reference straight line.

In the compressor according to the fifteenth aspect of the present invention, since the first inflow passage has a guide surface, in plan view, that is parallel to the second reference straight line, or is deflected forward in the rotation direction than the second reference straight line, oil in the crank chamber is easily guided to the first inflow passage.

Advantageous Effects of Invention

In the compressor according to the present invention, the oil discharge passage has, in addition to the first inflow passage that communicates with the crank chamber, the second inflow passage that communicates with the oil-recovery space, which is formed below the crank chamber in a lower part of the upper housing. Accordingly, the amount of oil that flows into the main oil discharge passage can be increased, and it is therefore possible to prevent that oil is collected in the crank chamber and pressure therein rises excessively.

DESCRIPTION OF EMBODIMENTS

Figure 1:
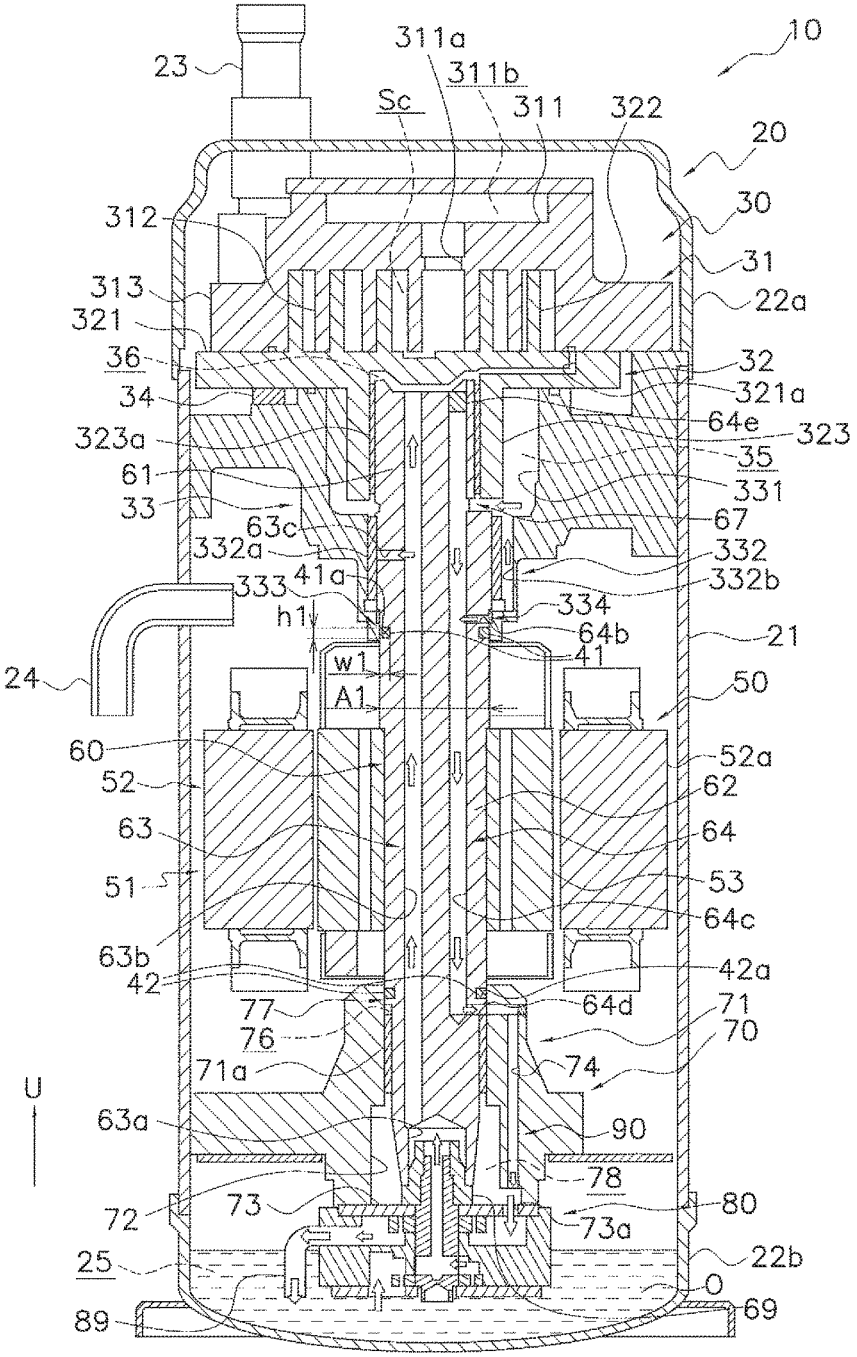
FIG. 1 is a schematic vertical cross-sectional view of the compressor according to a first embodiment of the present invention.

Below, embodiments of the present invention are described with examples. The embodiments below are merely practical examples, and various appropriate modifications are possible without deviating from the main point of the present invention.

First Embodiment

A compressor 10 according to a first embodiment of a compressor of the present invention is described, referring to the drawings.

(1) Overall Configuration

The compressor 10 according to the present embodiment is a scroll compressor. The compressor 10 is connected to a refrigerant circuit of refrigeration equipment, not shown. In the refrigerant circuit, a vapor compression-type refrigeration cycle is performed in which refrigerant is circulated.

Specifically, in the refrigerant circuit, refrigerant which has been compressed by the compressor 10 radiates heat at a condenser, is depressurized by a depressurization mechanism, absorbs heat at an evaporator, and is again drawn into the compressor 10.

As illustrated in FIG. 1, the compressor 10 primally has a casing 20, a compression mechanism 30, an electric motor 50, a driveshaft 60, a lower housing 70, and an oil pump 80. An in-shaft oil supply passage 63 to supply oil O (refrigerating machine oil) to a sliding part of the compressor 10, and an in-shaft oil discharge passage 64 are formed in the driveshaft 60 (see FIG. 1). The in-shaft oil discharge passage 64 constitutes a part of an oil discharge passage 90 for discharging oil O from a crank chamber 35 and an oil-recovery space 334, described later (see FIG. 1).

(2) Detailed Configuration

The configuration of the compressor 10 is described in detail below. In the following description, the direction of arrow U in FIG. 1 is taken to be upward when describing directions and positions, unless otherwise noted.

(2-1) Casing

The compressor 10 has a vertically long cylindrical-shape casing 20. As indicated in FIG. 1, the casing 20 has a cylinder member 21 having a cylindrical shape which opens above and below, and an upper lid 22*a* and a lower lid 22*b* arranged at the upper end and the lower end respectively of the cylinder member 21. The cylinder member 21, and the upper lid 22*a* and the lower lid 22*b* are fixed by welding so as to keep airtightness.

As indicated in FIG. 1, the casing 20 accommodates the constituent equipment of a compressor 10, including a compression mechanism 30, an electric motor 50, a driveshaft 60, a lower housing 70, and an oil pump 80. As indicated in FIG. 1, an oil retention space 25 is formed at the bottom part of the casing 20. Oil O for lubricating the driveshaft 60 and a sliding part of the compression mechanism 30 is collected in the oil retention space 25.

As indicated in FIG. 1, an intake tube 23 that takes in refrigerant, which is to be compressed by the compression mechanism 30, is provided in the upper part of the casing 20, passing through the upper lid 22*a*. The lower end of the intake tube 23 is connected to a fixed scroll 31 of the compression mechanism 30, described later. The intake tube 23 communicates with a compression chamber Sc of the compression mechanism 30, described later. Low-pressure refrigerant in the refrigerant circuit is supplied to the compression chamber Sc via the intake tube 23.

A discharge tube 24, through which refrigerant that is to be discharged outside the casing 20 passes, is arranged in an intermediate part of the cylinder member 21 of the casing 20 (see FIG. 1). The discharge tube 24 is disposed such that the end of the discharge tube 24 on the inside of the casing 20 protrudes between the upper housing 33 of the compression mechanism 30 and the electric motor 50, described later. High-pressure refrigerant in the refrigerant circuit, compressed by the compression mechanism 30, is discharged from the discharge tube 24.

(2-2) Compression Mechanism

The compression mechanism 30 is driven by the electric motor 50 and compresses the refrigerant. The compression mechanism 30 is disposed in the upper part in the casing 20 (see FIG. 1). As indicated in FIG. 1, the compression mechanism 30 primally has a fixed scroll 31, a movable scroll 32, an upper housing 33, and an Oldham coupling 34. The fixed scroll 31 is disposed above the upper housing 33. The movable scroll 32 is coupled with the fixed scroll 31 to form a compression chamber Sc. The upper housing 33 forms a crank chamber 35 in which a pin bearing 323 of the movable scroll 32 described later is disposed. The upper housing 33 has an upper bearing 332 that pivotally supports the driveshaft 60 below the crank chamber 35 (see FIG. 1). The upper housing 33 has an upper shaft seal part 333 below the upper bearing 332 (see FIG. 1). The Oldham coupling 34 prevents rotation of the movable scroll 32.

(2-2-1) Fixed Scroll

As indicated in FIG. 1, the fixed scroll 31 primally has a fixed-side plate 311, a fixed-side lap 312, and a peripheral part 313. The fixed-side lap 312 and the peripheral part 313 protrude downward from a surface of the fixed-side plate 311 on the movable scroll 32 side, or in other words, from the lower surface of the fixed-side plate 311. The fixed-side lap 312 is formed in a spiral shape.

The fixed-side plate 311 is formed in a disc shape. The fixed-side lap 312 and a movable-side lap 322 of the movable scroll 32, described later, are coupled such that the lower surface of the fixed-side plate 311 and the upper surface of a movable-side plate 321 of the movable scroll 32, described later, are opposed, and the compression chamber Sc in which refrigerant is compressed is formed between the fixed scroll 31 and the movable scroll 32 (see FIG. 1).

A discharge outlet 311*a* and discharge space 311*b* are formed in the fixed-side plate 311 (see FIG. 1). The discharge outlet 311*a* is formed passing through the center part of the fixed-side plate 311 in the thickness direction of the fixed-side plate 311 (see FIG. 1). The discharge outlet 311*a* communicates between the compression chamber Sc and the discharge space 311*b* (see FIG. 1). The discharge space 311*b* communicates with a space in the casing 20 below the upper housing 33 via a refrigerant passage (not shown) formed in the fixed scroll 31 and upper housing 33. Refrigerant that has been compressed in the compression chamber Sc of the compression mechanism 30 passes through the refrigerant passage (not shown) and flows into the space below the upper housing 33. When the compressor 10 is operated, the space below the upper housing 33 is filled with high-pressure refrigerant that has been compressed by the compression mechanism 30.

The peripheral part 313 is formed in a thick ring shape, and is disposed so as to surround the fixed-side lap 312 (see FIG. 1). When the movable scroll 32 revolves relative to the fixed scroll 31, an upper surface of the movable-side plate 321 of the movable scroll 32, described later, slidably contacts with a lower surface of the peripheral part 313.

(2-2-2) Movable Scroll

The movable scroll 32, which is one example of a movable part, is connected to the driveshaft 60. The movable scroll 32 is driven by the electric motor 50, which is connected to the driveshaft 60.

As indicated in FIG. 1, the movable scroll 32 primally has a movable-side plate 321, a movable-side lap 322, and a pin bearing 323.

The movable-side plate 321 is formed in a disc shape.

The movable-side lap 322 protrudes upward from a surface of the movable-side plate 321 on the fixed scroll 31 side, or in other words, from the upper surface of the movable-side plate 321 (see FIG. 1). The movable-side lap 322 is formed in a spiral shape.

The pin bearing 323 protrudes downward from a surface of the movable-side plate 321 on the electric motor 50 side, or in other words, from the lower surface of the movable-side plate 321 (see FIG. 1). The pin bearing 323 is formed in a cylindrical shape, and the upper-end opening of the cylinder is blocked by the movable-side plate 321. The pin bearing 323 is accommodated in the crank chamber 35, described later, which is formed by the upper housing 33. The movable scroll 32 and driveshaft 60 are connected by inserting a pin shaft 61 of the driveshaft 60, described later, into the pin bearing 323. A bearing metal 323*a* is fitted into the pin bearing 323. The pin shaft 61 inserted into the pin bearing 323 is rotatably supported by the bearing metal 323*a*. By connecting the movable scroll 32 to the driveshaft 60 in the pin bearing 323, the driveshaft 60 connected to the electric motor 50 rotates, and the movable scroll 32 is driven, when the electric motor 50 is operated.

An oil communication chamber 36 is formed in the cylindrical-shape pin bearing 323, between the upper-end surface of the pin shaft 61 of the driveshaft 60 that is inserted into the pin bearing 323 and the lower surface of the movable-side plate 321 (see FIG. 1). The oil communication chamber 36 communicates with the in-shaft oil supply passage 63 which is formed in the driveshaft 60. The oil communication chamber 36 receives a supply of oil O from the in-shaft oil supply passage 63.

A pin shaft channel (not shown) that extends in the vertical direction is formed between the pin shaft 61 and the bearing metal 323*a*. The upper end of the pin shaft channel opens into the oil communication chamber 36, and the lower end opens into the crank chamber 35. Oil O from the oil communication chamber 36 flows into the pin shaft channel. Oil O that has flowed into the pin shaft channel is supplied to the sliding part between the pin shaft 61 and the bearing metal 323*a*. After being supplied to the sliding part between the pin shaft 61 and the bearing metal 323*a*, the oil O flows into the crank chamber 35 formed by the upper housing 33.

An oil passage 321*a* is formed in the movable-side plate 321. The oil passage 321*a* extends from an opening on the lower surface of the movable-side plate 321 that communicates with the oil communication chamber 36 radially outwardly in the disc-shape movable-side plate 321, further extends upward, and opens on the upper surface of the movable-side plate 321.

(2-2-3) Upper Housing

The upper housing 33 is a cylinder-shape member that extends vertically. The upper housing 33 is press-fitted into the cylinder member 21, and the outer peripheral surface thereof is joined with the inner surface of the cylinder member 21 along the entirety in the circumferential direction (see FIG. 1). The fixed scroll 31 is fixed to the upper housing 33 in a state in which the lower surface of the peripheral part 313 of the fixed scroll 31 and the upper-end surface of the upper housing 33 are opposed (see FIG. 1). The driveshaft 60 is inserted into the cylinder-shaped upper housing 33 (see FIG. 1).

As indicated in FIG. 1, a recess 331 is formed in the center of the upper surface of the upper housing 33 so as to dent downward. As indicated in FIG. 1, the upper housing 33 has an upper bearing 332 disposed below the recess 331 and an upper shaft seal part 333 disposed below the upper bearing 332.

The recess 331 forms a crank chamber 35 in which the pin bearing 323 of the movable scroll 32 is disposed (see FIG. 1). In the crank chamber 35, the connecting portion that connects the pin shaft 61 of the driveshaft 60, which is inserted into the upper housing 33, and the movable scroll 32 (see FIG. 1) is accommodated. In other words, the crank chamber 35 accommodates the pin bearing 323 of the movable scroll 32, into which the pin shaft 61 of the driveshaft 60 is inserted (see FIG. 1).

Oil O that has been supplied to the sliding part between the pin shaft 61 of the driveshaft 60 and the bearing metal 323*a*, and oil O that has been supplied to the sliding part between the main shaft 62 of the driveshaft 60, described later, and the bearing metal 332*a*, flow into the recess 331 of the upper housing 33, that is, into the crank chamber 35. The crank chamber 35 communicates with a first inflow passage 67 of the in-shaft oil discharge passage 64, described later, formed in the driveshaft 60. Oil O that flows into the crank chamber 35 is discharged to the oil retention space 25 in the lower part of the casing 20 via the in-shaft oil discharge passage 64. Discharge of oil O from the crank chamber 35 is described later.

The upper bearing 332 is one example of a bearing. The upper bearing 332 is disposed below the crank chamber 35 (see FIG. 1). Bearing metal 332*a* is arranged in the upper bearing 332 (see FIG. 1). The bearing metal 332*a* pivotally supports the main shaft 62 of the driveshaft 60, which is inserted into the upper bearing 332 of the upper housing 33. In the upper bearing 332, an upper bearing oil discharge passage 332*b* extending in the vertical direction (see FIG. 1) is formed. The lower end of the upper bearing oil discharge passage 332*b* communicates with the oil-recovery space 334 disposed below the upper bearing 332 (see FIG. 1). The oil-recovery space 334 is described later. The upper end of the upper bearing oil discharge passage 332*b* communicates with the crank chamber 35 disposed above the upper bearing 332. The upper bearing oil discharge passage 332*b* is a passage that leads a part of the oil O that has been supplied to the sliding part between the bearing metal 332*a* of the upper bearing 332 and the main shaft 62 of the driveshaft 60 to the crank chamber 35. Among the oil O that has been supplied to the sliding part between the bearing metal 332*a* of the upper bearing 332 and the main shaft 62 of the driveshaft 60, the oil O that does not flow into the crank chamber 35 flows into the oil-recovery space 334.

The upper shaft seal part 333 is disposed below the upper bearing 332 (see FIG. 1). The upper shaft seal part 333 is formed in a cylindrical shape. The inside diameter of the upper shaft seal part 333 is substantially equal to the outside diameter of the main shaft 62 of the driveshaft 60, which is disposed within the upper shaft seal part 333. The inside diameter of the upper shaft seal part 333 is slightly larger than the outside diameter of the main shaft 62 of the driveshaft 60, which is disposed within the upper shaft seal part 333. The upper shaft seal part 333 prevents leakage of oil O from the lower part of the gap between the upper housing 33 and the driveshaft 60.

An annular space is formed between the upper bearing 332 and the upper shaft seal part 333, and between the upper housing 33 and the driveshaft 60, so as to surround the driveshaft 60. The annular space may be formed between the main shaft 62 and the upper housing 33 by reducing the outside diameter of the main shaft 62 of the driveshaft 60, or may be formed between the main shaft 62 and the upper housing 33 by increasing the inside diameter of the upper housing 33. This space functions as an oil-recovery space 334 (see FIG. 1). The oil-recovery space 334 is formed in the lower part of the upper housing 33. A portion of the oil O that has been supplied to the sliding part between the bearing metal 332*a* of the upper bearing 332 and the main shaft 62 of the driveshaft 60 flows into the oil-recovery space 334. The oil-recovery space 334 communicates with a second inflow passage 64*b*, described later, of the in-shaft oil discharge passage 64 formed in the driveshaft 60. Oil O that has flowed into the oil-recovery space 334 is discharged into the oil retention space 25 in the lower part of the casing 20, via the in-shaft oil discharge passage 64. Discharge of oil O from the oil-recovery space 334 is described later.

An upper shaft seal ring 41 is disposed at the upper shaft seal part 333 (see FIG. 1). By disposing the upper shaft seal ring 41 at the upper shaft seal part 333, leakage of oil O from the lower part of the upper housing 33 is prevented even if the pressure in the crank chamber 35 rises, and oil loss can be suppressed.

Specifically, the upper shaft seal ring 41 is disposed at the lower part of the upper shaft seal part 333 and between the upper shaft seal part 333 and the driveshaft 60 (see FIG. 1). The upper shaft seal ring 41 is disposed in an annular seal ring groove 41*a*, which is formed on the main shaft 62 of the driveshaft 60 at a region that opposes the upper shaft seal part 333 (see FIG. 1). The upper shaft seal ring 41 may be disposed in an annular seal ring groove formed on the upper shaft seal part 333 instead of being disposed in a seal ring groove 41*a* formed in the main shaft 62 of the driveshaft 60.

The upper shaft seal ring 41 is made of metal or of resin. For example, a metal material with good high-temperature characteristics, or a resin material is used in the upper shaft seal ring 41. The upper shaft seal ring 41 is formed in an annular shape, and has an abutment (a cut portion), not shown. The shape of the abutment is for example an angle-cut shape. However, the invention is not limited thereto; the shape of the abutment may be, for example, a step-cut shape or the like. The shape of the abutment may be determined appropriately. The value of the ratio of the axial-direction height h1 of the upper shaft seal ring 41 (see FIG. 1) to the diameter A1 of the main shaft 62 of the driveshaft 60 at a portion where the upper shaft seal ring 41 is installed (the diameter of a portion at which the seal ring groove 41*a* is not formed, see FIG. 1) is 0.047, but such an arrangement is not provided by way of limitation. In order to obtain sufficient seal properties, it is preferable that the value of the ratio of the axial-direction height h1 of the upper shaft seal ring 41 to the diameter A1 of the main shaft 62 of the driveshaft 60 at a portion where the upper shaft seal ring 41 is installed be 0.04 or greater and less than 0.07. The value of the ratio of the radial-direction thickness w1 of the upper shaft seal ring 41 (see FIG. 1) to the diameter A1 of the main shaft 62 of the driveshaft 60 at a portion where the upper shaft seal ring 41 is installed is 0.040, but such an arrangement is not provided by way of limitation. In order to obtain sufficient seal properties, it is preferable that the value of the ratio of the radial-direction thickness w1 of the upper shaft seal ring 41 to the diameter A1 of the main shaft 62 of the portion of the driveshaft 60 at a portion where the upper shaft seal ring 41 is installed be 0.03 or greater and less than 0.06.

(2-2-4) Oldham Coupling

The Oldham coupling 34 is provided at the upper surface of the upper housing 33 (see FIG. 1). The Oldham coupling 34 is slidably fitted into the movable-side plate 321 of the movable scroll 32 and the upper housing 33. The Oldham coupling 34 prevents rotation of the movable scroll 32, which is driven by the electric motor 50. Through the action of the Oldham coupling 34, the movable scroll 32 revolves relative to the fixed scroll 31 without rotating.

(2-3) Electric Motor

The electric motor 50 is disposed below the upper housing 33 of the compression mechanism 30 (see FIG. 1). The electric motor 50 has a stator 51 that is fixed to an inner-wall surface of the cylinder member 21, and a rotor 53 that is rotatably accommodated on the inside of the stator 51 with a slight gap (air gap) provided (see FIG. 1).

The stator 51 has a tube-shape stator core 52 and windings (not shown) that are wound around the stator core 52. A core cut 52*a*, extending in the vertical direction, is formed in the outer peripheral surface of the stator core 52 (see FIG. 1). At the portion of the core cut 52*a*, a gap is formed between the stator core 52 and the cylinder member 21 of the casing 20.

In a compressor of a type that differs from the present compressor 10 in that oil that collects in the crank chamber is returned to the oil retention space via the gap at a core cut portion, the core cut needs to be formed to be large. In contrast, in the present compressor 10, since an in-shaft oil discharge passage 64 to return oil O in the crank chamber 35 to the oil retention space 25 is formed in the driveshaft 60, the core cut 52*a* can be comparatively small. Accordingly, compared with a compressor of the type that returns oil that collects in the crank chamber to the oil retention space via the gap at the core cut portion, the motor efficiency of the compressor 10 can be improved.

The rotor 53 is formed in a tube shape. By inserting the driveshaft 60 into the rotor 53, the rotor 53 and the driveshaft 60 are connected. The driveshaft 60 is also connected to the movable scroll 32. That is, the rotor 53 is connected to the movable scroll 32 via the driveshaft 60. The electric motor 50 drives the movable scroll 32 by causing the rotor 53 to rotate.

(2-4) Driveshaft

The driveshaft 60 extends in the vertical direction along the axial center of the cylinder member 21 of the casing 20 (see FIG. 1). The driveshaft 60 is connected to the rotor 53 of the electric motor 50, and transmits the driving power of the electric motor 50 to the movable scroll 32.

The driveshaft 60 has a main shaft 62, the center axis of which coincides with the axial center of the cylinder member 21, and a pin shaft 61 that is eccentric relative to the main shaft 62 (see FIG. 1). The pin shaft 61 is one example of an eccentric part.

The pin shaft 61 is formed to have a smaller diameter than the main shaft 62. As stated above, the pin shaft 61 is inserted into the pin bearing 323 of the movable scroll 32. The pin shaft 61 is rotatably supported by the bearing metal 323*a* that is disposed within the pin bearing 323.

The main shaft 62 is rotatably supported by the bearing metal 332*a* of the upper bearing 332 of the upper housing 33 and by a bearing metal 71*a* of a lower bearing 71 of the lower housing 70, described later (see FIG. 1). The main shaft 62 is connected to the rotor 53 of the electric motor 50 between the upper bearing 332 and the lower bearing 71 (see FIG. 1). In plan view, the driveshaft 60 rotates about a rotation center C (see FIG. 2 and FIG. 4). The rotation center C is the center position of the main shaft 62 in plan view. In the present embodiment, the main shaft 62 (driveshaft 60) rotates counterclockwise in plan view (see the rotation direction K in FIG. 4).

In the driveshaft 60, the in-shaft oil supply passage 63 to supply oil O to the sliding part of the compressor 10 is formed, as indicated in FIG. 1. Further, as indicated in FIG. 1, the in-shaft oil discharge passage 64 communicating the crank chamber 35 and the oil-recovery space 334 is formed in the driveshaft 60 to discharge oil O that has collected in the crank chamber 35 and the oil-recovery space 334. The in-shaft oil supply passage 63 and in-shaft oil discharge passage 64 are described later.

An oil pump shaft receiver 69 is fixed to the lower end of the main shaft 62 of the driveshaft 60 (see FIG. 1). Specifically, the oil pump shaft receiver 69 is inserted into and secured in an opening of an inflow passage 63*a* of the in-shaft oil supply passage 63, described later, that is formed at the lower end of the main shaft 62.

The oil pump shaft receiver 69 is a hollow member. An oil pump shaft 84 of the oil pump 80 is inserted into the hollow part of the oil pump shaft receiver 69 from the lower-end side, as described later (see FIG. 9). As described later, an axial-direction joint passage 84*b* is formed in the oil pump shaft 84 (see FIG. 9). The axial-direction joint passage 84*b* communicates with the inflow passage 63*a* of the in-shaft oil supply passage 63, into which the oil pump shaft receiver 69 is inserted (see FIG. 9).

(2-5) Lower Housing

The lower housing 70 is disposed in the lower part in the casing 20 (see FIG. 1). The lower housing 70 is disposed below the electric motor 50. The lower housing 70 is a cylinder-shape member that extends vertically. A part of the outer peripheral surface of the lower housing 70 protrudes toward the cylinder member 21 of the casing 20 (see FIG. 10) and is fixed to the cylinder member 21. The driveshaft 60 is inserted into the cylinder-shape lower housing 70 (see FIG. 1).

The upper part of the lower housing 70 has a lower shaft seal part 77 (see FIG. 1) on its upper part. The lower housing 70 has a lower bearing 71 below the lower shaft seal part 77 (see FIG. 1). In the lower part of the lower housing 70, a recess 72 that dents upward is formed (see FIG. 1). The oil pump 80 is fixed to the lower-end surface of the lower housing 70 so as to block the lower opening of the recess 72 (see FIG. 1).

The lower bearing 71 pivotally supports the driveshaft 60. A bearing metal 71*a* is arranged in the lower bearing 71 (see FIG. 1). The bearing metal 71*a* pivotally supports the main shaft 62 of the driveshaft 60 disposed in the lower bearing 71 of the lower housing 70.

The lower shaft seal part 77 is formed in a cylinder shape. The inside diameter of the lower shaft seal part 77 is substantially equal to the outside diameter of the main shaft 62 of the driveshaft 60, which is disposed in the lower shaft seal part 77. The inside diameter of the lower shaft seal part 77 is slightly larger than the outside diameter of the main shaft 62 of the driveshaft 60, which is disposed in the lower shaft seal part 77. The lower shaft seal part 77 prevents leakage of oil O from the upper part of the gap between the lower housing 70 and the driveshaft 60.

Figure 9:
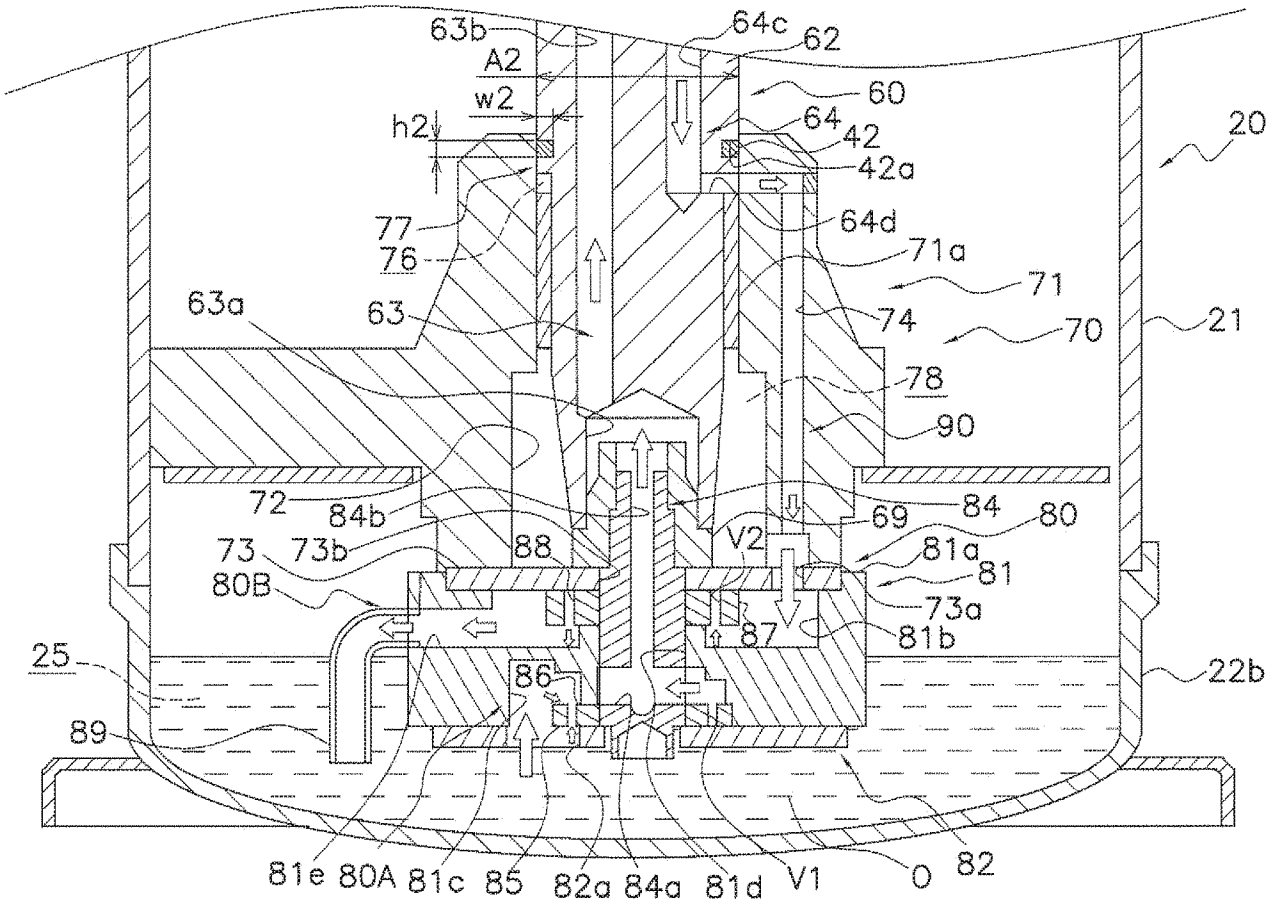
FIG. 9 is an enlarged view of the periphery of the lower housing and oil pumps of the compressor of FIG. 1.

An annular space is formed between the lower bearing 71 and the lower shaft seal part 77 and between the lower housing 70 and the driveshaft 60, so as to surround the driveshaft 60 (see FIG. 9). The annular space may be formed between the main shaft 62 and the lower housing 70 by reducing the outside diameter of a part of the main shaft 62 of the driveshaft 60, or may be formed between the main shaft 62 and the lower shaft seal part 77 by reducing the inside diameter of a part of the lower housing 70. This space functions as an annular space 76 (see FIG. 1). The annular space 76 is a space that is adjacent to the bearing metal 71*a* of the lower bearing 71 (see FIG. 9). The annular space 76 communicates with a main oil discharge passage 64*c* of the in-shaft oil discharge passage 64, described later, via an outflow passage 64*d* of the in-shaft oil discharge passage 64, described later (see FIG. 9). Oil O that has flowed through the main oil discharge passage 64*c* and the outflow passage 64*d* flows into the annular space 76. Moreover, a part of the oil O that has been supplied to the sliding part between the bearing metal 71*a* of the lower bearing 71 and the main shaft 62 of the driveshaft 60 flows into the annular space 76. The annular space 76 communicates with an in-lower-housing oil discharge passage 74 formed in the lower housing 70. The in-lower-housing oil discharge passage 74 is one example of an oil passage. The in-lower-housing oil discharge passage 74 communicates with a lower space 78 that is surrounded by the recess 72 of the lower housing 70 and the oil pump 80 (see FIG. 9). Oil O that flows into the annular space 76 passes through the in-lower-housing oil discharge passage 74 and flows into the lower space 78. Further, a part of the oil O that has been supplied to the sliding part between the bearing metal 71*a* of the lower bearing 71 and the main shaft 62 of the driveshaft 60 flows directly (without passing through the in-lower-housing oil discharge passage 74) into the lower space 78. Oil O that has flowed into the lower space 78 is led to the oil discharge pump part 80B of the oil pump 80, described later, and flows into the oil retention space 25. That is, the in-lower-housing oil discharge passage 74 communicate between the annular space 76 and the oil retention space 25 via the lower space 78 and the oil discharge pump part 80B.

A lower shaft seal ring 42 is arranged at the lower shaft seal part 77. Because the lower shaft seal ring 42 is arranged at the lower shaft seal part 77, leakage of oil O from the upper part of the lower housing 70 can be prevented, and oil loss can be suppressed.

Specifically, the lower shaft seal ring 42 is disposed between the lower shaft seal part 77 and the driveshaft 60, at the upper part of the lower shaft seal part 77 (see FIG. 9). The lower shaft seal ring 42 is disposed in an annular seal ring groove 42*a*, which is formed on the main shaft 62 of the driveshaft 60 at a region that opposes the lower shaft seal part 77 (see FIG. 9). The lower shaft seal ring 42 may be disposed in an annular seal ring groove formed on the lower shaft seal part 77 instead of being disposed in a seal ring groove 42*a* formed in the main shaft 62 of the driveshaft 60.

The lower shaft seal ring 42 is made of metal or of resin. For example, a metal material with good high-temperature characteristics, or a resin material is used in the lower shaft seal ring 42. The lower shaft seal ring 42 is formed in an annular shape, and has an abutment (a cut portion), not shown. The shape of the abutment is, for example, an angle-cut shape. However, the invention is not limited thereto; the shape of the abutment may be, for example, a step-cut shape or the like. The shape of the abutment may be determined appropriately. The value of the ratio of the axial-direction height h2 of the lower shaft seal ring 42 (see FIG. 9) to the diameter A2 of the main shaft 62 of the driveshaft 60 at a position where the lower shaft seal ring 42 is installed (the diameter of a portion at which the seal ring groove 42*a* is not formed, see FIG. 9) is 0.053, but such an arrangement is not provided by way of limitation. In order to obtain sufficient seal properties, it is preferable that the value of the ratio of the axial-direction height h2 of the lower shaft seal ring 42 to the diameter A2 of the main shaft 62 of the driveshaft 60 at a portion where the lower shaft seal ring 42 is installed be 0.04 or greater and less than 0.07. The value of the ratio of the radial-direction thickness w2 of the lower shaft seal ring 42 (see FIG. 9) to the diameter A2 of the main shaft 62 of the driveshaft 60 at a portion where the lower shaft seal ring 42 is installed is 0.045, but such an arrangement is not provided by way of limitation. In order to obtain sufficient seal properties, it is preferable that the value of the ratio of the radial-direction thickness w2 of the lower shaft seal ring 42 to the diameter A2 of the main shaft 62 of the driveshaft 60 at a portion where the lower shaft seal ring 42 is installed be 0.03 or greater and less than 0.06.

(2-6) In-Shaft Oil Supply Passage

The in-shaft oil supply passage 63 is one example of an oil supply passage. The in-shaft oil supply passage 63 is an oil passage to supply oil O in the oil retention space 25, supplied by the oil supply pump part 80A of the oil pump 80, described later, to each of the sliding parts of the compressor 10. The in-shaft oil supply passage 63 is formed in the driveshaft 60 (see FIG. 1). The in-shaft oil supply passage 63 transports oil O in the oil retention space 25 to the upper end of the pin shaft 61 of the driveshaft 60, which is disposed in the crank chamber 35. In other words, the in-shaft oil supply passage 63 transports oil O in the oil retention space 25 to the crank chamber 35.

Figure 2:
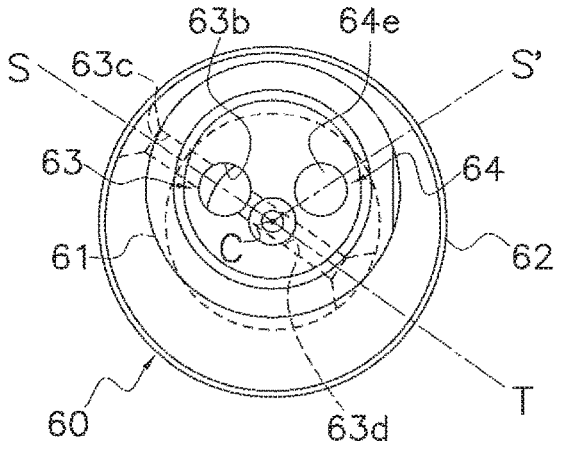
FIG. 2 is a top view of the driveshaft of the compressor of FIG. 1. An upper outflow passage and lower outflow passage, formed in the driveshaft, are illustrated by dashed lines.
Figure 3:
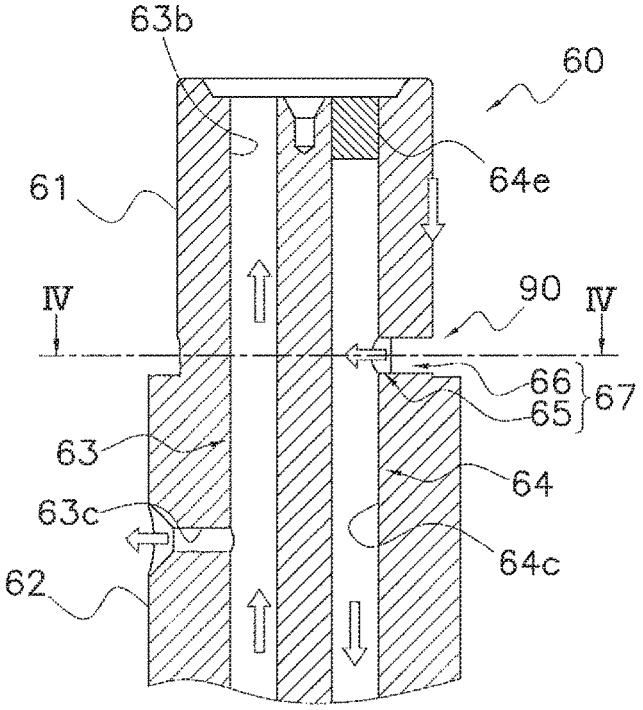
FIG. 3 is a schematic vertical cross-sectional view of an upper part of the driveshaft of the compressor of FIG. 1, illustrating a cross-sectional view of the driveshaft sectioned across cross-section S-C-S' of FIG. 2.
Figure 7:
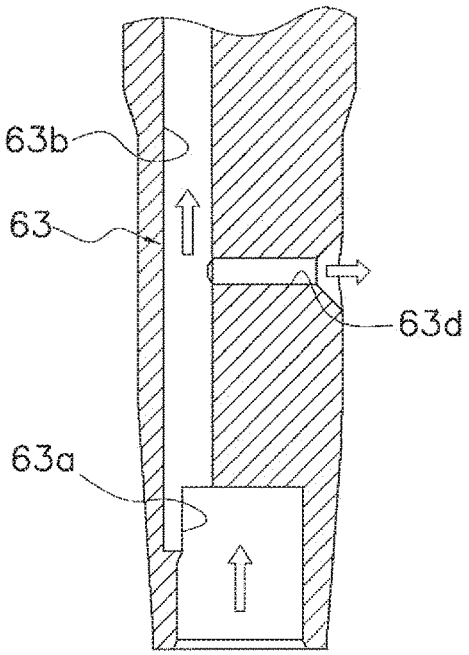
FIG. 7 is a schematic vertical cross-sectional view of a lower part of the driveshaft of the compressor of FIG. 1. A cross-sectional view of the driveshaft, sectioned across cross-section S-C-T in FIG. 2, is illustrated.

As indicated in FIG. 1, FIG. 3 and FIG. 7, the in-shaft oil supply passage 63 primally has an inflow passage 63*a*, a main oil supply passage 63*b*, an upper outflow passage 63*c*, and a lower outflow passage 63*d*. FIG. 3 is a cross-sectional view in which the upper part of the driveshaft 60 is sectioned at the S-C-S' cross-section in FIG. 2. FIG. 7 is a cross-sectional view in which the lower part of the driveshaft 60 is sectioned at the S-C-T cross-section in FIG. 2. In FIG. 2. C indicates the rotation center C of the driveshaft 60.

The inflow passage 63*a* is a recess that opens in the lower end of the driveshaft 60 (see FIG. 7). The inflow passage 63*a* is formed so as to dent upward from the lower end in the center part of the driveshaft 60 (see FIG. 7). The oil pump shaft receiver 69 is inserted from the lower-end opening into the inflow passage 63*a*. Further, the oil pump shaft 84 of the oil pump 80, described later, is inserted into the hollow oil pump shaft receiver 69. The inflow passage 63*a* communicates with the axial-direction joint passage 84*b* formed in the oil pump shaft 84 of the oil pump 80 (see FIG. 9). Oil O in the oil retention space 25 is supplied from the inflow passage 63*a* to the in-shaft oil supply passage 63 by the oil supply pump part 80A of the oil pump 80.

The main oil supply passage 63*b* extends in the axial direction, that is, in the vertical direction, in the driveshaft 60. The lower end of the main oil supply passage 63*b* communicates with the inflow passage 63*a*. The upper end of the main oil supply passage 63*b* opens at the upper-end surface of the pin shaft 61 of the driveshaft 60. The main oil supply passage 63*b* communicates with the oil communication chamber 36.

The upper outflow passage 63*c* extends in the driveshaft 60 from the main oil supply passage 63*b* in a direction intersecting the axial direction. In particular, in the present embodiment, the upper outflow passage 63*c* extends in the driveshaft 60 from the main oil supply passage 63*b* in a direction perpendicular to the axial direction (see FIG. 3). The upper outflow passage 63*c* extends in the driveshaft 60 from the main oil supply passage 63*b* in the radial direction (see FIG. 2). The upper outflow passage 63*c* opens at the outer peripheral surface of the driveshaft 60 at the upper bearing 332 of the upper housing 33. Oil O that flows out from the opening of the upper outflow passage 63*c* on the outer peripheral surface of the driveshaft 60 is supplied to the sliding part between the bearing metal 332*a* of the upper bearing 332 and the main shaft 62 of the driveshaft 60.

The lower outflow passage 63*d* extends in the driveshaft 60 from the main oil supply passage 63*b* in a direction intersecting the axial direction (see FIG. 7). In particular, in the present embodiment, the lower outflow passage 63*d* extends in the driveshaft 60 from the main oil supply passage 63*b* in a direction perpendicular to the axial direction (see FIG. 7). The lower outflow passage 63*d* extends in the driveshaft 60 from the main oil supply passage 63*b* in the radial direction (see FIG. 2). The lower outflow passage 63*d* opens at the outer peripheral surface of the driveshaft 60 at the lower bearing 71 of the lower housing 70. Oil O that flows out from the opening of the lower outflow passage 63*d* on the outer peripheral surface of the driveshaft 60 is supplied to the sliding part between the bearing metal 71*a* of the lower bearing 71 and the main shaft 62 of the driveshaft 60.

In the present embodiment, the opening of the upper outflow passage 63*c* on the outer peripheral surface of the driveshaft 60 and the opening of the lower outflow passage 63*d* on the outer peripheral surface of the driveshaft 60 are disposed approximately 180° away relative to the rotation center C of the driveshaft 60 (see FIG. 2). In other words, in plan view, the upper outflow passage 63*c* and the lower outflow passage 63*d* extend substantially on a straight line that passes through the rotation center C of the driveshaft 60. As shown in FIG. 2, in plan view, the upper outflow passage 63*c* and the lower outflow passage 63*d* substantially extend on the straight line S-T extending to pass through the rotation center C of the driveshaft 60.

By disposing the opening of the upper outflow passage 63*c* on the outer peripheral surface of the driveshaft 60 and the opening of the lower outflow passage 63*d* on the outer peripheral surface of the driveshaft 60 with axial symmetry relative to the rotation center C of the driveshaft 60, oil film generation at the sliding part of the upper bearing 332 and the sliding part of the lower bearing 71 is facilitated. The reason for this is as follows. With respect to the mechanisms, at the upper bearing 332 and the lower bearing 71, the directions (angles) at which the load is received are substantially the opposite directions relative to the rotation center C of the driveshaft 60 (substantially different by 180°). Moreover, the mode in which the upper bearing 332 and the lower bearing 71 receive a load is a "rotating load," where the magnitudes of load are substantially constant, but the load directions fluctuate in synchronization with the shaft rotation. Accordingly, if openings of outflow passages are respectively designed to be arranged on opposite sides of the direction in which the load is supported (substantially at the angles of the positions of minimum oil film thickness) at the upper bearing 332 and the lower bearing 71, the flow of oil O supplied to the upper bearing 332 and the lower bearing 71 can be maximally increased.

However, if the upper outflow passage 63*c* and the lower outflow passage 63*d* are branched from the same main oil supply passage 63*b* as indicated in FIG. 2 and FIG. 7, the oil O flowing to one among the main oil supply passage 63*b* and the upper outflow passage 63*c* flows against the centrifugal force caused due to rotation of the driveshaft 60. In the present embodiment, the flow of oil O that flows in the lower outflow passage 63*d* goes against the centrifugal force, and it can be difficult to supply oil to the lower bearing 71 (see FIG. 7).

Figure 8:
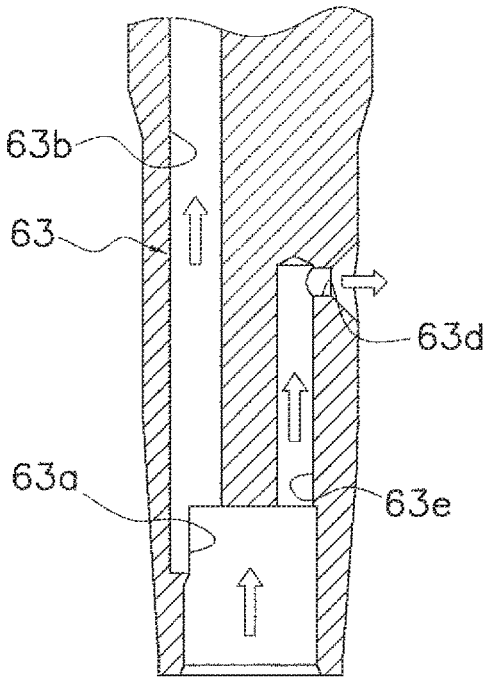
FIG. 8 is a schematic vertical cross-sectional view of a lower part of the driveshaft of a compressor according to another embodiment, illustrating a cross-sectional view of the driveshaft sectioned across cross-section S-C-T in FIG. 2.

Hence in another embodiment, a dedicated lower bearing passage (vertical hole) 63*e*, extending in the axial direction from the inflow passage 63*a* and being separate from the main oil supply passage 63*b*, may be provided at the position that is axially symmetric with the main oil supply passage 63*b* relative to the rotation center C of the driveshaft 60, as indicated in FIG. 8. Moreover, the lower outflow passage 63*d* may be communicated with the dedicated lower bearing passage 63*e* and not with the main oil supply passage 63*b*, so that oil O is supplied to the lower outflow passage 63*d* via the dedicated lower bearing passage 63*e*. By using a configuration such as that of FIG. 8, oil O flowing in the lower outflow passage 63*d* also flows along the centrifugal force, and oil O can easily be supplied to the lower bearing 71.

(2-7) Oil Discharge Passage

The oil discharge passage 90 is an oil passage that leads oil O in the crank chamber 35 and the oil-recovery space 334, and oil O that has been supplied to the lower bearing 71, to the oil discharge pump part 80B of the oil pump 80. The oil discharge passage 90 primally includes the in-shaft oil discharge passage 64, the annular space 76, the in-lower-housing oil discharge passage 74, and the lower space 78 surrounded by the recess 72 of the lower housing 70 and the oil pump 80 (see FIG. 1).

The in-shaft oil discharge passage 64 leads the oil O in the crank chamber 35 and the oil-recovery space 334 to the annular space 76 formed around the main shaft 62 of the driveshaft 60. The oil O in the annular space 76 is transported to the lower space 78 through the in-lower-housing oil discharge passage 74. The oil O that has collected in the crank chamber 35 includes oil O that has been supplied to the sliding part between the pin shaft 61 of the driveshaft 60 and the bearing metal 323*a* of the first pin bearing 323. The oil O that collects in the crank chamber 35 includes oil O that, after being supplied to the sliding part between the main shaft 62 of the driveshaft 60 and the bearing metal 332*a* of the upper bearing 332, passes through the upper bearing oil discharge passage 332*b* and flows into the crank chamber 35. The oil O that flows into the oil-recovery space 334 includes oil O that has been supplied to the sliding part between the main shaft 62 of the driveshaft 60 and the bearing metal 332*a* of the upper bearing 332. The oil O that flows into the annular space 76 includes oil O that has flowed from the in-shaft oil discharge passage 64, and a part of the oil O that has been supplied to the sliding part between the main shaft 62 of the driveshaft 60 and the bearing metal 71*a* of the lower bearing 71.

The in-shaft oil discharge passage 64 primally has the first inflow passage 67, the second inflow passage 64*b*, the main oil discharge passage 64*c*, and the outflow passage 64*d* (see FIG. 1).

The first inflow passage 67 communicates between the main oil discharge passage 64*c* and the crank chamber 35 (see FIG. 1). The first inflow passage 67 is formed in a base of the pin shaft 61 (see FIG. 3, FIG. 5 and FIG. 6). The pin shaft 61 of the driveshaft 60 is disposed in the crank chamber 35 formed by the upper housing 33, but in the present embodiment, the space in the in-shaft oil discharge passage 64 (the space within the pin shaft 61) is defined as a space that is different from the crank chamber 35. That is, in the cross-sectional view of FIG. 4, the space in the first inflow passage 67 and the main oil discharge passage 64*c*, which is formed in the inside of the outer peripheral edge of the pin shaft 61, is defined as the space that is different from the crank chamber 35.

The main oil discharge passage 64*c* is a hole that extends in the driveshaft 60 in the axial direction, that is, in the vertical direction. The main oil discharge passage 64*c* is formed to be circular in plan view. The main oil discharge passage 64*c* extends from the upper end surface of the pin shaft 61 of the driveshaft 60 to the lower part of the driveshaft 60. The opening of the main oil discharge passage 64*c* at the upper end is closed by a plug 64*e* (see FIG. 1). Accordingly, the main oil discharge passage 64*c* does not communicate with the oil communication chamber 36 formed above the pin shaft 61.

Figure 4:
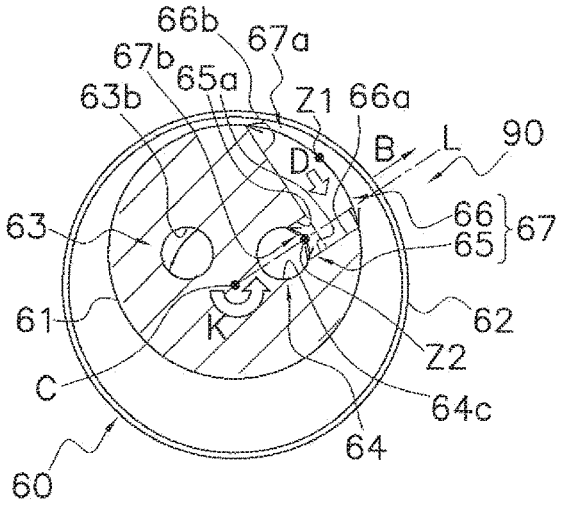
FIG. 4 is a cross-sectional view viewing from the arrow direction of IV-IV in FIG. 3.

The first inflow passage 67 primally has an intake hole 65 and an introduction part 66 (see FIG. 3 and FIG. 4).

The intake hole 65 is one example of an outlet-vicinity part. The intake hole 65 is a hole that opens into the main oil discharge passage 64*c*. The opening of the intake hole 65 into the main oil discharge passage 64*c* is referred to as an inflow passage outlet 67*b* (see FIGS. 4-6). That is, the intake hole 65 is arranged near the inflow passage outlet 67*b*, and more precisely, adjacent to the inflow passage outlet 67*b*. The inflow passage outlet 67*b* is an opening formed in the outer peripheral edge of the main oil discharge passage 64*c*. In other words, the inflow passage outlet 67*b* is an opening that, in a case that the main oil discharge passage 64*c* were supposed to be a solid column member, would be formed on the outer peripheral surface of the column member by opening the intake hole 65. In plan view, the inflow passage outlet 67*b* is disposed on the outer peripheral edge of the main oil discharge passage 64*c*, in the interval indicated by the double-headed arrow in FIG. 4.

The intake hole 65 extends in a straight line from the main oil discharge passage 64*c*, or in other words, from the inflow passage outlet 67*b*. Seen in a side view (seen from a direction perpendicular to the axial direction of the driveshaft 60), the intake hole 65 is a hole formed in a circular shape (see FIG. 6). Accordingly, the inflow passage outlet 67*b* is also formed to be circular in a side view (see FIG. 6).

The intake hole 65 extends in a straight line that intersects the axial direction of the driveshaft 60. In particular, in the present embodiment, the intake hole 65 extends along a straight line that is perpendicular to the axial direction of the driveshaft 60. In plan view, the intake hole 65 extends along a straight line L that passes through the rotation center C of the driveshaft 60 (the center of the main shaft 62) and the centroid Z2 of the inflow passage outlet 67*b*, and is perpendicular to the axial direction of the driveshaft 60 (see FIG. 3). In the present embodiment, the centroid Z2 of the inflow passage outlet 67*b* in plan view means the centroid of an imagined figure, which is an imagined figure of small width extending along the outer peripheral edge of the main oil discharge passage 64*c* in the interval of the outer peripheral edge of the main oil discharge passage 64*c* in which the inflow passage outlet 67*b* is disposed (the interval of the outer peripheral edge of the main oil discharge passage 64*c* indicated by the double-headed arrow in FIG. 4).

In plan view, the intake hole 65 has a pair of straight parts 65*a* extending in straight lines from the inflow passage outlet 67*b* (see FIG. 4). Both straight parts 65*a* extend from the inflow passage outlet 67*b* parallel to a straight line L toward the outside of the pin shaft 61 (see the direction of the arrow B in FIG. 4).

Figure 5:
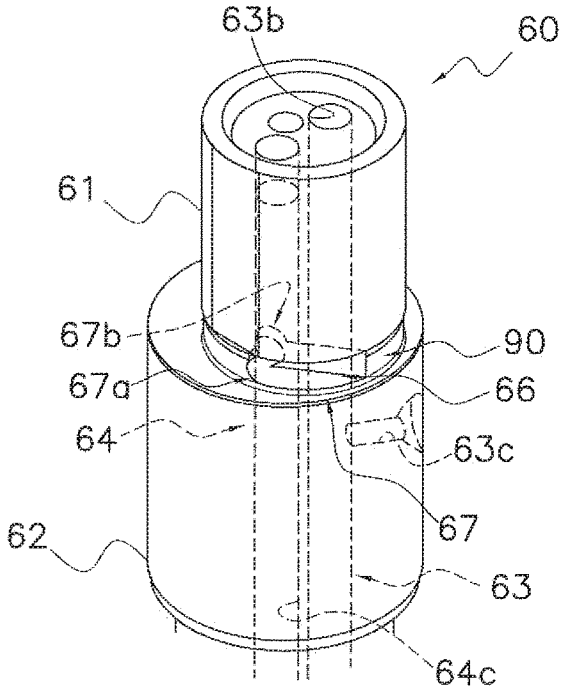
FIG. 5 is a perspective view of an upper part of the driveshaft of the compressor of FIG. 1. An in-shaft oil supply passage and in-shaft oil discharge passage formed within the driveshaft are illustrated by dashed lines.

The introduction part 66 is formed in the base of the pin shaft 61 so as to core out the interior of the pin shaft 61 from the outer peripheral surface of the pin shaft 61 (see FIG. 5). In plan view, the introduction part 66 is the space surrounded by the outer peripheral edge of the pin shaft 61 (the interval which is formed on the inflow passage inlet 67*a*, described later, and is indicated by the double-headed arrow in FIG. 4), a first surface 66*a* that extends continuously from one of the straight parts 65*a* of the intake hole 65, a second surface 66*b* that extends in a direction perpendicular to the straight line L, and the intake hole 65. In plan view, the introduction part 66 is formed so as to extend longer in a direction perpendicular to the straight line L (a direction in which the second surface 66*b* extends) than the direction of the straight line L (a direction in which the first surface 66*a* extends).

The introduction part 66 is a space that communicates with the intake hole 65 (see FIG. 3 and FIG. 4). Further, the introduction part 66 is a space that communicates with the crank chamber 35 (see FIG. 3 and FIG. 4). In other words, the introduction part 66 opens into the crank chamber 35. The opening of the introduction part 66 into the crank chamber 35 is referred to as the inflow passage inlet 67*a* (see FIGS. 4-6). The inflow passage inlet 67*a* is an opening formed in the outer peripheral edge of the pin shaft 61 (see FIG. 5). In plan view, the inflow passage inlet 67*a* is disposed in the interval on the outer peripheral edge of the pin shaft 61 indicated by the double-headed arrow in FIG. 4. In a side view seen from the direction facing the second surface 66*b* of the introduction part 66, the inflow passage inlet 67*a* is formed in a rectangular shape that extends longer in the horizontal direction (see FIG. 6). The oil O in the crank chamber 35 flows into the introduction part 66 through the inflow passage inlet 67*a*.

There are the following relations between the inflow passage inlet 67*a*, which is the inlet for oil O from the crank chamber 35 into the first inflow passage 67 (the inflow passage inlet 67*a* that opens into the crank chamber 35), and the inflow passage outlet 67*b*, which is the outlet for oil O from the first inflow passage 67 to the main oil discharge passage 64*c* (the inflow passage outlet 67*b* that opens into the main oil discharge passage 64*c*).

Figure 6:
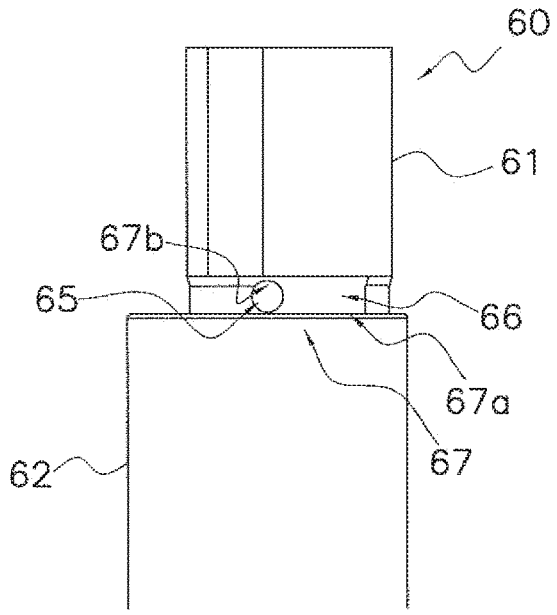
FIG. 6 is a view of an upper part of the driveshaft of the compressor of FIG. 1, seen from a side (a direction perpendicular to the axial direction)

1) The area of the inflow passage inlet 67*a* that is formed on the outer peripheral surface of the pin shaft 61 is larger than the area of the inflow passage outlet 67*b* that is formed on the outer peripheral edge of the main oil discharge passage 64*c* (see FIG. 5 and FIG. 6).

2) The inflow passage inlet 67*a* is deflected forward in the rotation direction K of the driveshaft 60 than the inflow passage outlet 67*b*. In other words, in plan view, the centroid Z1 of the inflow passage inlet 67*a* is positioned on the forward side in the rotation direction K of the driveshaft 60 relative to the straight line L that passes through the centroid Z2 of the inflow passage outlet 67*b* and extends in the direction B (see FIG. 4). In the present embodiment, the centroid Z1 of the inflow passage inlet 67*a* in plan view means the centroid of an imagined figure, which is an imagined figure of small width extending along the outer peripheral edge of the pin shaft 61 in the interval where the inflow passage inlet 67*a* is disposed at the outer peripheral edge of the pin shaft 61 (the interval of the outer peripheral edge of the pin shaft 61 indicated by the double-headed arrow in FIG. 4). In other words, in plan view, the centroid Z1 of the inflow passage inlet 67*a* is positioned on the forward side in the rotation direction K of the driveshaft 60 relative to the straight line L that extends from the rotation center C of the driveshaft 60 through the centroid Z2 of the inflow passage outlet 67*b* (see FIG. 4).

Since the inflow passage inlet 67*a* is configured to have an area larger than the area of the inflow passage outlet 67*b* as indicated in 1) above, oil O in the crank chamber 35 is readily guided to the main oil discharge passage 64*c* by the first inflow passage 67 compared with a case in which the area of the inflow passage inlet 67*a* is not larger than the area of the inflow passage outlet 67*b*.

Further, since the inflow passage inlet 67*a* is deflected forward in the rotation direction K of the driveshaft 60 than the inflow passage outlet 67*b* as indicated in 2) above, when the driveshaft 60 rotates, oil O is readily guided to the introduction part 66 from the inflow passage inlet 67*a*, which is disposed forward side in the rotation direction K than the inflow passage outlet 67*b*, and oil O is readily guided to the main oil discharge passage 64*c*.

In particular, in the present embodiment, the introduction part 66 has the first surface 66*a* that extends in a direction that intersects the rotation direction K. The first surface 66*a* is one example of a guide surface. In plan view, the first surface 66*a* is a linear extension of the straight part 65*a* of the intake hole 65 on the rearward side in the rotation direction K of the driveshaft 60 (the straight part 65*a* of the intake hole 65 further on the rearward side in the rotation direction K than the straight line L) (see FIG. 4). That is, in plan view, the introduction part 66 has a first surface 66*a* that extends parallel to the straight line L (see FIG. 4). When the driveshaft 60 rotates in the rotation direction K, oil O flows in the direction opposite the rotation direction K (the direction D in FIG. 4) in the introduction part 66, the flow direction is changed by the first surface 66*a*, and oil O is guided to the intake hole 65 and then to the main oil discharge passage 64*c*.

In the present embodiment, the intake hole 65 is formed with a drill, and thereafter the introduction part 66 is formed with an end mill. However, the formation methods of the intake hole 65 and the introduction part 66 are an example, and the invention is not limited thereto. Various machining methods can be applied as formation methods of the intake hole 65 and the introduction part 66.

The second inflow passage 64*b* communicates between the main oil discharge passage 64*c* and the oil-recovery space 334.

The second inflow passage 64*b* extends in the driveshaft 60 from the main oil discharge passage 64*c* in a direction that intersects with the axial direction. In particular, in the present embodiment, the second inflow passage 64*b* extends in the driveshaft 60 in a direction perpendicular to the axial direction. The second inflow passage 64*b* extends in the driveshaft 60 in a radial direction from the main oil discharge passage 64*c*. The second inflow passage 64*b* is formed in a position at the height of the oil-recovery space 334 of the upper housing 33. The second inflow passage 64*b* opens on the outer peripheral surface of the driveshaft 60 in the oil-recovery space 334 formed above the upper shaft seal part 333. One end of the second inflow passage 64*b* communicates with the oil-recovery space 334, and the other end communicates with the main oil discharge passage 64*c*. Oil O in the oil-recovery space 334 flows into the in-shaft oil discharge passage 64 from the opening of the second inflow passage 64*b*.

If, hypothetically, the second inflow passage 64*b* were not formed in the driveshaft 60, oil O that had been supplied to the sliding part between the bearing metal 332*a* of the upper bearing 332 and the main shaft 62 of the driveshaft 60 would all be caused to flow into the crank chamber 35, and would be caused to flow from the first inflow passage 64*a* to the main oil discharge passage 64*c*. In contrast, in the present embodiment, since the second inflow passage 64*b* is formed, oil O that had been supplied to the sliding part between the bearing metal 332*a* of the upper bearing 332 and the main shaft 62 of the driveshaft 60 can also be caused to flow from the second inflow passage 64*b* into the main oil discharge passage 64*c*. Consequently, excessive collection of oil O in the crank chamber 35 can be prevented.

The outflow passage 64*d* extends in the driveshaft 60 from the lower end of the main oil discharge passage 64*c* in a direction that intersects the axial direction. In particular, in the present embodiment, the outflow passage 64*d* extends in the driveshaft 60 from the lower end of the main oil discharge passage 64*c* in a direction perpendicular to the axial direction. The outflow passage 64*d* extends in the driveshaft 60 from the lower end of the main oil discharge passage 64*c* in a radial direction. The outflow passage 64*d* opens on the outer peripheral surface of the main shaft 62 of the driveshaft 60 in the annular space 76 formed between the lower housing 70 and the main shaft 62 of the driveshaft 60. That is, the outflow passage 64*d* communicates with the annular space 76. Oil O that has flowed into the annular space 76 is discharged, via the in-lower-housing oil discharge passage 74 formed in the lower housing 70, into the lower space 78 surrounded by the recess 72 of the lower housing 70 and the oil pump 80.

Oil O that is discharged from the in-shaft oil discharge passage 64 flows into the lower space 78. Further, oil O that has been supplied to the sliding part between the bearing metal 71*a* of the lower bearing 71 and the main shaft 62 of the driveshaft 60 flows into the lower space 78, directly, or after passing through the annular space 76 and the in-lower-housing oil discharge passage 74. Oil O that has flowed into the lower space 78 is led to the oil discharge pump part 80B of the oil pump 80 via a discharge outlet 73*a* formed in a thrust plate 73 of the oil pump 80, described later (see FIG. 1).

(2-8) Oil Pump

The oil pump 80 is a double trochoidal positive displacement pump.

Figure 10:
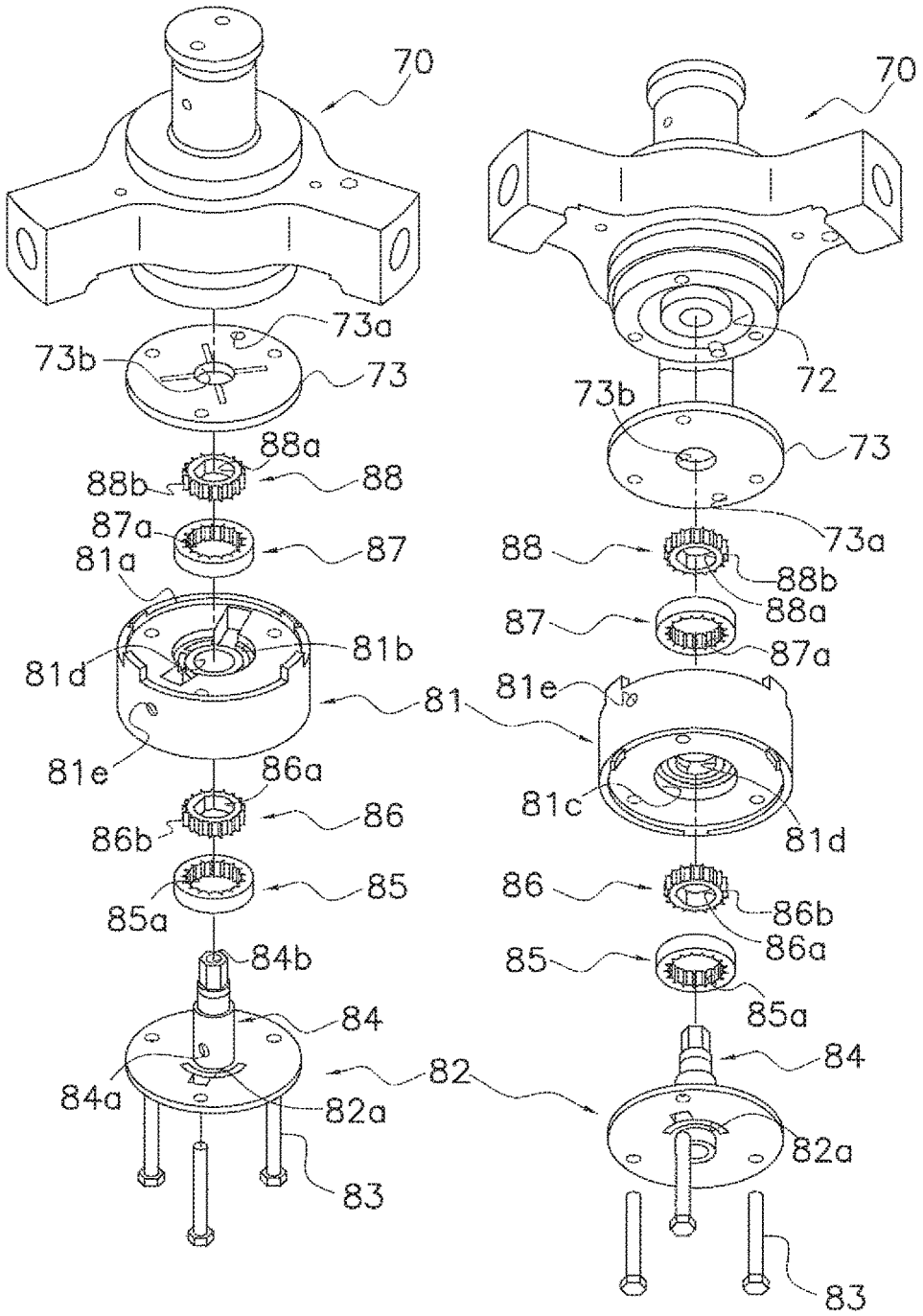
FIG. 10 is an exploded perspective view of the oil pumps of the compressor of FIG. 1.

As indicated in FIG. 10, the oil pump 80 is fastened to the lower-end surface of the lower housing 70 with bolts 83. The oil pump 80 primally has a thrust plate 73, a pump body 81, a pump cover 82, an oil pump shaft 84, a lower-side outer rotor 85, a lower-side inner rotor 86, an upper-side outer rotor 87, and an upper-side inner rotor 88.

The oil pump 80 includes an oil supply pump part 80A that supplies oil O in the oil retention space 25 to the in-shaft oil supply passage 63, and an oil discharge pump part 80B that discharges oil O in the crank chamber 35 to the oil retention space 25 via the oil discharge passage 90 (see FIG. 9). The oil supply pump part 80A is one example of an oil supply pump. The oil discharge pump part 80B is one example of an oil discharge pump.

The oil supply pump part 80A includes the lower-side outer rotor 85 and the lower-side inner rotor 86 (see FIG. 9). The oil discharge pump part 80B includes the upper-side outer rotor 87 and the upper-side inner rotor 88 (see FIG. 9). Driving force is transmitted to the lower-side inner rotor 86 of the oil supply pump part 80A and to the upper-side inner rotor 88 of the oil discharge pump part 80B through the oil pump shaft 84. The oil pump shaft 84 is connected to the lower part of the driveshaft 60, and when the driveshaft 60 rotates, the oil pump shaft 84 also rotates. Because of rotation of the oil pump shaft 84, the lower-side inner rotor 86 and the upper-side inner rotor 88 are driven, and the oil supply pump part 80A functions as a displacement-type oil supply pump, while the oil discharge pump part 80B functions as a displacement-type oil discharge pump.

Below, the oil pump 80 is described in detail.

The thrust plate 73 is formed in a disc shape (see FIG. 10). The thrust plate 73 is installed in the lower housing 70 so as to block the recess 72 formed in the lower housing 70 (see FIG. 9 and FIG. 10). The lower-end surface of the oil pump shaft receiver 69 installed on the lower end of the driveshaft 60 is in sliding contact with the thrust plate 73 (see FIG. 9). The thrust plate 73 receives the thrust force of the driveshaft 60.

In the center part of the thrust plate 73 in the radial direction, an insertion hole 73*b* for insertion of the lower part of the oil pump shaft 84 is formed (see FIG. 9 and FIG. 10). In the outer peripheral part of the thrust plate 73, a discharge outlet 73*a* to guide oil O in the lower space 78 above the thrust plate 73 to the oil discharge pump part 80B is formed (see FIG. 9 and FIG. 10). The upper end of the discharge outlet 73*a* communicates with the lower space 78, and the lower end communicates with an in-body upper-side channel 81*b* in the pump body 81, described later.

The pump body 81 is a substantially cylindrical shape member that extends in the vertical direction. In the pump body 81, the oil pump shaft 84, the lower-side outer rotor 85, the lower-side inner rotor 86, the upper-side outer rotor 87, and the upper-side inner rotor 88 are accommodated (see FIG. 9). On the peripheral edge of the upper part of the pump body 81, an outer peripheral edge 81*a* protruding upward is formed (see FIG. 10). The pump body 81 is fixed to the lower housing 70 in a state in which the thrust plate 73 is fitted to the inside of the outer peripheral edge 81*a* (see FIG. 9).

In the center part of the upper surface of the pump body 81, an in-body upper-side channel 81*b* dented downward is formed (see FIG. 9 and FIG. 10). In the center part of the lower surface of the pump body 81, an in-body lower-side channel 81*c* dented upward is formed (see FIG. 9 and FIG. 10). The in-body lower-side channel 81*c* is formed in a circular shape in plan view. Further, in the center part of the pump body 81, an inner peripheral hole 81*d*, into which the oil pump shaft 84 is inserted, is formed (see FIG. 9 and FIG. 10).

In the pump body 81, a discharge channel 81*e*, that extends in a horizontal direction and penetrates through the inside and the outside, is formed (see FIG. 9 and FIG. 10). One end (the end on the inside) of the discharge channel 81*e* opens into the in-body upper-side channel 81*b*, and the other end (the end on the outside) opens on the outer peripheral surface of the pump body 81 (see FIG. 9).

Pump outlet piping 89 is installed at the discharge channel 81*e* (see FIG. 9). The pump outlet piping 89 is formed in an L shape. The pump outlet piping 89 extends in a horizontal direction along the discharge channel 81*e*, then changes direction by 90°, and extends downward. The lower end of the pump outlet piping 89 is disposed below the lower end of the oil pump 80. The lower end of the pump outlet piping 89 is disposed in the lower part of the oil retention space 25. The pump outlet piping 89 guides oil O that has flowed from the oil discharge pump part 80B via the discharge channel 81*e* to the lower part of the oil retention space 25.

In the present embodiment, oil O is not discharged from the discharge channel 81*e* in a horizontal direction, but instead, oil O is discharged to the lower part of the oil retention space 25 through the pump outlet piping 89. Therefore, it can be prevented that mist of the oil O is transported together with refrigerant and discharged from the discharge tube 24 to the refrigerant circuit. Further, since the discharge channel 81*e* opens near the liquid surface in the oil retention space 25, if there were no pump outlet piping 89, oil O discharged from the discharge channel 81*e* would disturb the liquid surface, and there would be the concern that scattering of mist of the oil O would be promoted. In contrast, in the present embodiment, oil O is discharged to the lower part of the oil retention space 25 through the pump outlet piping 89, and therefore the liquid surface of the oil retention space 25 is not disturbed.

The pump cover 82 is formed in substantially a disc shape (see FIG. 10). The pump cover 82 is fastened to the lower surface of the pump body 81 (see FIG. 9 and FIG. 10).

The oil pump shaft 84 is rotatably supported in the center part of the pump cover 82 (see FIG. 9 and FIG. 10). Moreover, in the pump cover 82, an arc-shape intake inlet 82*a* that, in plan view, is on the outside of the oil pump shaft 84 supported by the pump cover 82 is formed (see FIG. 9 and FIG. 10). The intake inlet 82*a* is formed passing through the pump cover 82 in the vertical direction. The lower end of the intake inlet 82*a* opens into the oil retention space 25. The upper end of the intake inlet 82*a* opens into the in-body lower-side channel 81*c* formed in the pump body 81. When the oil pump shaft 84 rotates and the oil supply pump part 80A is driven, oil O in the oil retention space 25 flows into the in-body lower-side channel 81*c* through the intake inlet 82*a*.

The oil pump shaft 84 is formed in a circular shape, and extends in the vertical direction (see FIG. 9). The lower part of the oil pump shaft 84 is rotatably supported by the pump cover 82 (see FIG. 9 and FIG. 10). The oil pump shaft 84 is inserted into the inner peripheral hole 81*d* formed in the pump body 81, and is rotatably supported by the pump body 81 (see FIG. 9 and FIG. 10). The oil pump shaft 84 is inserted into the insertion hole 73*b* in the thrust plate 73, which is disposed in the upper part of the pump body 81 (see FIG. 9 and FIG. 10). Further, the oil pump shaft 84 is inserted from below into the interior of the oil pump shaft receiver 69 installed in the inflow passage 63*a* formed in the lower end of the main shaft 62 of the driveshaft 60, and is fitted with the oil pump shaft receiver 69 (see FIG. 9 and FIG. 10). Specifically, the upper end of the oil pump shaft 84, which is formed in a hexagonal shape, is inserted into a hexagonal-shape hole provided in an inside-diameter part of the oil pump shaft receiver 69. That is, the oil pump shaft 84 is connected to the lower part of the driveshaft 60 via the oil pump shaft receiver 69. By connecting the oil pump shaft 84 to the driveshaft 60, the oil pump shaft 84 rotates integrally with the driveshaft 60.

In the interior of the oil pump shaft 84, a radial-direction joint passage 84*a* and the axial-direction joint passage 84*b* are formed (see FIG. 9 and FIG. 10). The radial-direction joint passage 84*a* penetrates the oil pump shaft 84 in a radial direction (see FIG. 9). The radial-direction joint passage 84*a* opens into the in-body lower-side channel 81*c* of the pump body 81. The axial-direction joint passage 84*b* extends in the oil pump shaft 84 in the axial direction (in the vertical direction). The axial-direction joint passage 84*b* opens in the upper-end surface of the oil pump shaft 84, and communicates with the inflow passage 63*a* of the in-shaft oil supply passage 63 formed within the driveshaft 60 (see FIG. 9). The lower end of the axial-direction joint passage 84*b* communicates with the radial-direction joint passage 84*a* (see FIG. 9). When the oil pump shaft 84 rotates, oil O in the in-body lower-side channel 81*c* passes through the radial-direction joint passage 84*a* and the axial-direction joint passage 84*b*, and is supplied to the in-shaft oil supply passage 63 (see FIG. 9).

The lower-side outer rotor 85 is fitted into the in-body lower-side channel 81*c*. The lower-side outer rotor 85 is formed in a toroidal shape, and in the inner peripheral surface of which a plurality of outside teeth 85*a* in arc shapes (more precisely, in trochoidal curve shapes) are formed (see FIG. 10). The plurality of outside teeth 85*a* are arrayed at equal intervals in the circumferential direction, and swell toward the side of the lower-side inner rotor 86 disposed within the lower-side outer rotor 85.

The lower-side inner rotor 86 is formed in a toroidal shape (see FIG. 10). The lower-side inner rotor 86 is disposed within the lower-side outer rotor 85 (see FIG. 9). The lower-side inner rotor 86 is fitted to the outside of the oil pump shaft 84. Specifically, a D-shape holding hole 86*a* is formed inside the lower-side inner rotor 86 (see FIG. 10). By inserting the oil pump shaft 84 into this holding hole 86*a*, the lower-side inner rotor 86 and the oil pump shaft 84 are connected, and the lower-side inner rotor 86 rotates integrally with the oil pump shaft 84. On the outer peripheral surface of the lower-side inner rotor 86, a plurality of inside teeth 86*b* are formed corresponding to the outside teeth 85*a* of the lower-side outer rotor 85 (see FIG. 10). By disposing the lower-side inner rotor 86 in the lower-side outer rotor 85 such that the inside teeth 86*b* and the outside teeth 85*a* mutually mesh, a displacement chamber V1 to convey oil O is formed between the inside teeth 86*b* and the outside teeth 85*a* (see FIG. 9).

The lower-side portion of the oil pump 80, which includes the lower-side inner rotor 86 and the lower-side outer rotor 85, constitutes the oil supply pump part 80A. In the oil supply pump part 80A, oil O in the oil retention space 25 flows in from the intake inlet 82*a* of the pump cover 82, passes through the displacement chamber V1 between the lower-side inner rotor 86 and the lower-side outer rotor 85 in the in-body lower-side channel 81*c*, and is supplied to the in-shaft oil supply passage 63 through the radial-direction joint passage 84*a* and the axial-direction joint passage 84*b*.

The upper-side outer rotor 87 is fitted into the in-body upper-side channel 81*b*. The upper-side outer rotor 87 is formed in a toroidal shape, and on the inner peripheral surface thereof, a plurality of outside teeth 87*a* in arc shapes (more precisely, in trochoidal curve shapes) are formed (see FIG. 10). The plurality of outside teeth 87*a* are arrayed at equal intervals in the circumferential direction, and swell toward the side of the upper-side inner rotor 88 disposed within the upper-side outer rotor 87.

The upper-side inner rotor 88 is formed in a toroidal shape (see FIG. 10). The upper-side inner rotor 88 is disposed in the upper-side outer rotor 87 (see FIG. 9). The upper-side inner rotor 88 is fitted with the outside of the oil pump shaft 84. Specifically, a D-shape holding hole 88*a* is formed inside the upper-side inner rotor 88 (see FIG. 10). By inserting the oil pump shaft 84 into this holding hole 88*a*, the upper-side inner rotor 88 and the oil pump shaft 84 are connected, and the upper-side inner rotor 88 rotates integrally with the oil pump shaft 84. On the outer peripheral surface of the upper-side inner rotor 88, a plurality of inside teeth 88*b* are formed corresponding to the outside teeth 87*a* of the upper-side outer rotor 87 (see FIG. 10). By disposing the upper-side inner rotor 88 in the upper-side outer rotor 87 such that the inside teeth 88*b* and the outside teeth 87*a* mutually mesh, a displacement chamber V2 to convey oil O is formed between the inside teeth 88*b* and the outside teeth 87*a* (see FIG. 9). The displacement chamber V2 between the upper-side inner rotor 88 and the upper-side outer rotor 87 is larger than the displacement chamber V1 between the lower-side inner rotor 86 and the lower-side outer rotor 85.

The upper-side portion of the oil pump 80, which includes the upper-side inner rotor 88 and the upper-side outer rotor 87, constitutes the oil discharge pump part 80B. In the discharge pump part 80B, oil O passes from the lower space 78 that constitutes a part of the discharge passage 90, through the discharge outlet 73*a* of the thrust plate 73, into the in-body upper-side channel 81*b*, passes through the displacement chamber V2 between the upper-side inner rotor 88 and the upper-side outer rotor 87 in the in-body upper-side channel 81*b*, and is discharged into the oil retention space 25 at the bottom part of the casing 20 through the discharge channel 81*e* formed in a side surface of the pump body 81.

As indicated above, since the displacement chamber V2 between the upper-side inner rotor 88 and the upper-side outer rotor 87 is larger than the displacement chamber V1 between the lower-side inner rotor 86 and the lower-side outer rotor 85, the discharge rate by the oil discharge pump part 80B is larger than the discharge rate by the oil supply pump part 80A. In the present embodiment, discharge rates mean the theoretical discharge rates of the oil supply pump part 80A and the oil discharge pump part 80B. The actual discharge rate of the oil discharge pump part 80B may be smaller than the actual discharge rate of the oil supply pump part 80A.

The extent by which the volume of the displacement chamber V2 is set to be larger than the volume of the displacement chamber V1 (the extent by which the discharge rate of the oil discharge pump part 80B is set to be larger than the discharge rate of the oil supply pump part 80A) is determined appropriately such that there is no excessive collection of oil O in the crank chamber 35.

(3) Action of Operation

The basic action of operation of the compressor 10 is described.

During operation of the compressor 10, the electric motor 50 is run, and the rotor 53 rotates. When the rotor 53 rotates, the driveshaft 60 connected to the rotor 53 also rotates. When the driveshaft 60 rotates, the pin shaft 61 undergoes eccentric rotation. As a result, the movable scroll 32, in which the pin shaft 61 is inserted into the pin bearing 323, rotates. The movable scroll 32 revolves relative to the fixed scroll 31 without rotation due to the action of the Oldham coupling 34. When the movable scroll 32 is revolved, low-pressure refrigerant in the refrigerant circuit is drawn into the casing 20 through the intake tube 23. More specifically, low-pressure refrigerant in the refrigerant circuit passes through the intake tube 23 and is drawn from the peripheral edge side of the fixed-side lap 312 into the compression chamber Sc. As the movable scroll 32 revolves, the intake tube 23 and the compression chamber Sc cease to communicate. The compression chamber Sc approaches the center from the peripheral edge side as the volume thereof decreases. As a result, the pressure of refrigerant in the compression chamber Sc rises. High-pressure refrigerant that has been compressed by the compression mechanism 30 is discharged into the discharge space 311*b* through the discharge outlet 311*a* formed near the center of the fixed-side plate 311. High-pressure refrigerant in the refrigerant circuit that has been discharged into the discharge space 311*b* passes through the refrigerant passage (not shown) that is formed in the fixed scroll 31 and the upper housing 33, and flows into the lower space of the upper housing 33. High-pressure refrigerant that has flowed into the lower space of the upper housing 33 is discharged from the discharge tube 24 and sent to the refrigerant circuit.

(4) Oil Supply/Discharge Action

Action to supply and discharge oil O in the compressor 10 is described.

First, action to supply oil O is described.

When the compressor 10 is operated and the driveshaft 60 rotates, the oil supply pump part 80A of the oil pump 80 is driven. Specifically, rotation of the oil pump shaft 84 that is connected to the driveshaft 60 causes the lower-side inner rotor 86 to rotate within the lower-side outer rotor 85. As a result, the volume of the displacement chamber V1 expands and contracts, and oil O in the oil retention space 25 is drawn into the oil supply pump part 80A of the oil pump 80.

More specifically, oil O in the oil retention space 25 is drawn into the displacement chamber V1 in the in-body lower-side channel 81*c* via the intake inlet 82*a* of the pump cover 82. Oil O discharged from the displacement chamber V1 flows in the radial-direction joint passage 84*a* and the axial-direction joint passage 84*b*, and flows into the inflow passage 63*a* of the in-shaft oil supply passage 63.

Oil O that has flowed into the inflow passage 63*a* of the in-shaft oil supply passage 63 rises in the main oil supply passage 63*b*. When, as indicated in the embodiment of FIG. 8, the dedicated lower bearing passage 63*e* is provided, oil O that has flowed into the inflow passage 63*a* rises in the main oil supply passage 63*b* and the dedicated lower bearing passage 63*e*.

When, as indicated in the embodiment of FIG. 7, the lower outflow passage 63*d* communicates with the main oil supply passage 63*b*, a part of the oil O that rises in the main oil supply passage 63*b* is supplied to the lower bearing 71 through the lower outflow passage 63*d*. When, as indicated in the embodiment of FIG. 8, the dedicated lower bearing passage 63*e* is provided, oil O that rises in the dedicated lower bearing passage 63*e* is supplied to the lower bearing 71 through the lower outflow passage 63*d*. Oil O that has been supplied to the lower bearing 71 lubricates the sliding part between the bearing metal 71*a* and the main shaft 62 of the driveshaft 60. Then, the oil O flows out to the annular space 76 formed below the lower shaft seal part 77 of the lower housing 70, or to the lower space 78 surrounded by the recess 72 of the lower housing 70. Oil O that has flowed into the annular space 76 passes through the in-lower-housing oil discharge passage 74 and flows out to the lower space 78.

A part of the oil O that rises in the main oil supply passage 63*b* is supplied to the upper bearing 332 through the upper outflow passage 63*c*. Oil O that has been supplied to the upper bearing 332 lubricates the sliding part between the bearing metal 332*a* and the main shaft 62 of the driveshaft 60. Then, a part of the oil O passes through the upper bearing oil discharge passage 332*b* and flows into the crank chamber 35 formed by the upper housing 33. The remaining oil O flows into the oil-recovery space 334 formed above the upper shaft seal part 333 in the lower part of the upper housing 33.

A part of the oil O that rises in the main oil supply passage 63*b* rises to the upper end of the main oil supply passage 63*b* and flows into the oil communication chamber 36. A part of the oil O that has flowed into the oil communication chamber 36 flows into the oil passage 321*a* formed in the movable scroll 32, and the remainder flows into a pin shaft channel, not shown. Oil O that has flowed into the oil passage 321*a* is supplied to the thrust surfaces between the fixed scroll 31 and the movable scroll 32, to the gap between the fixed-side lap 312 and the movable-side lap 322, and the like. Oil O that has flowed into the pin shaft channel is supplied to the sliding part between the bearing metal 323*a* in the pin bearing 323 and the pin shaft 61 of the driveshaft 60, and lubricates the sliding part. Then, the oil O flows out into the crank chamber 35 formed by the upper housing 33.

Next, action to discharge oil O is described.

When the compressor 10 is operated and the driveshaft 60 rotates, the oil discharge pump part 80B of the oil pump 80 is also driven. Specifically, by rotation of the oil pump shaft 84 that is connected to the driveshaft 60, the upper-side inner rotor 88 rotates within the upper-side outer rotor 87. As a result, the volume of the displacement chamber V2 of the oil discharge pump part 80B expands and contracts, and oil O in the crank chamber 35 flows into the introduction part 66 from the inflow passage inlet 67*a*. Oil O that has flowed into the introduction part 66 is guided by the first surface 66*a* to flow into the intake hole 65, passes through the intake hole 65, and flows into the main oil discharge passage 64*c*. Oil O in the oil-recovery space 334 passes through the second inflow passage 64*b* and flows into the main oil discharge passage 64*c*. Oil O that has flowed into the main oil discharge passage 64*c* from the first inflow passage 67 and the second inflow passage 64*b* moves downward in the main oil discharge passage 64*c*, passes through the outflow passage 64*d*, and flows out to the annular space 76. Oil O that has flowed into the annular space 76 passes through the in-lower-housing oil discharge passage 74 and flows into the lower space 78 the sides of which are surrounded by the recess 72 of the lower housing 70. Oil O in the lower space 78 passes through the discharge outlet 73*a* formed in the thrust plate 73 and flows into the oil discharge pump part 80B of the oil pump 80. More specifically, oil O that has passed through the discharge outlet 73*a* flows into the in-body upper-side passage 81*b*, and is drawn into the displacement chamber V2 within the in-body upper-side passage 81*b*. Oil O that is discharged from the displacement chamber V2 passes through the discharge channel 81*e* formed within the pump body 81, passes through the pump outlet piping 89, and is discharged to the oil retention space 25 at the bottom of the casing 20.

(5) Features (5-1)

The compressor 10 of the present embodiment is provided with the casing 20, the electric motor 50, the driveshaft 60, the compression mechanism 30, the in-shaft oil supply passage 63 as one example of an oil supply passage, the oil discharge passage 90, the oil supply pump part 80A as one example of an oil supply pump, and the oil discharge pump part 80B as one example of an oil discharge pump. The oil retention space 25 is formed in the bottom part of the casing 20. The electric motor 50 is accommodated in the casing 20. The driveshaft 60 extends in the vertical direction and is connected to the electric motor 50. The compression mechanism 30 has the movable scroll 32 as one example of a movable part, and the upper housing 33. The movable scroll 32 is connected to the driveshaft 60, and is driven by the electric motor 50. The upper housing 33 forms the crank chamber 35 which accommodates the connecting portion of the pin shaft 61 (the pin bearing 323 of the movable scroll 32) of the driveshaft 60 and the movable scroll 32. The pin shaft 61 is one example of an eccentric part of the driveshaft 60. The compression mechanism 30 is accommodated in the casing 20. The upper housing 33 has the upper bearing 332 that pivotally supports the driveshaft 60 below the crank chamber 35. The in-shaft oil supply passage 63 leads oil O in the oil retention space 25 to the crank chamber 35. The in-shaft oil supply passage 63 is formed in the driveshaft 60. The oil discharge passage 90 includes the main oil discharge passage 64*c* and the first inflow passage 67. The main oil discharge passage 64*c* extends in the axial direction in the driveshaft 60. The first inflow passage 67 communicates between the main oil discharge passage 64*c* and the crank chamber 35. The oil supply pump part 80A supplies oil O in the oil retention space 25 to the in-shaft oil supply passage 63. The oil discharge pump part 80B discharges oil O in the crank chamber 35 to the oil retention space 25 via the oil discharge passage 90. The oil-recovery space 334 is formed in the lower part of the upper housing 33, below the crank chamber 35. The in-shaft oil discharge passage 64 further includes the second inflow passage 64*b* communicating between the main oil discharge passage 64*c* and the oil-recovery space 334.

In the present embodiment, the oil discharge passage 90 has, in addition to the first inflow passage 67 which communicates with the crank chamber 35, the second inflow passage 64*b* that communicates with the oil-recovery space 334 which is formed below the crank chamber 35 in the lower part of the upper housing 33. Accordingly, the amount of oil O that flows into the main oil discharge passage 64*c* can be increased, and it is therefore possible to prevent that oil O is collected in the crank chamber 35 and the pressure therein rises excessively.

(5-2)

In the compressor 10 of the present embodiment, the oil-recovery space 334 is formed below the upper bearing 332.

In the present embodiment, oil O which has reached to below the upper bearing 332 and might leak out from the lower part of the upper housing 33 can be led to the oil retention space 25 via the in-shaft oil discharge passage 64, and the occurrence of oil loss due to oil O that has leaked from the lower part of the upper housing 33 can be prevented.

(5-3)

In the compressor 10 of the present embodiment, the upper housing 33 has the upper shaft seal part 333 that is disposed below the oil-recovery space 334. The compressor 10 is provided with the upper shaft seal ring 41 that is disposed at the upper shaft seal part 333.

In the present embodiment, since the upper shaft seal ring 41 is disposed at the upper shaft seal part 333 below the oil-recovery space 334, even if the pressure in the crank chamber 35 has risen, leakage of oil O from the lower part of the upper housing 33 can be prevented, and oil loss can be suppressed.

The upper shaft seal ring 41 needs not to be provided, but in order to more easily prevent leakage of oil O from the lower part of the upper housing 33, it is preferable that the upper shaft seal ring 41 be provided.

(5-4)

The compressor 10 of the present embodiment is provided with the lower housing 70 and the lower shaft seal ring 42. The lower housing 70 has the lower bearing 71 and the lower shaft seal part 77. The lower bearing 71 pivotally supports the driveshaft 60. The lower shaft seal part 77 is disposed above the lower bearing 71. The lower shaft seal ring 42 is disposed at the lower shaft seal part 77.

In the present embodiment, because the lower shaft seal ring 42 is disposed at the lower shaft seal part 77 of the lower housing 70, leakage of oil O from the upper part of the lower housing 70 can be prevented, and oil loss can be more easily suppressed.

The lower shaft seal ring 42 needs not to be provided, but in order to more easily prevent leakage of oil O from the upper part of the lower housing 70, it is preferable that the lower shaft seal ring 42 be provided.

(5-5)

In the compressor 10 of the present embodiment, the annular space 76 is disposed below the lower shaft seal part 77. The annular space 76 is formed so as to surround the driveshaft 60. The annular space 76 communicates with the main oil discharge passage 64*c*. The in-lower-housing oil discharge passage 74 which communicates between the annular space 76 and the oil retention space 25 is formed in the lower housing 70. The in-lower-housing oil discharge passage 74 is one example of an oil passage.

In the present embodiment, by providing the annular space 76 and the in-lower-housing oil discharge passage 74, a passage in which oil O from the main oil discharge passage 64*c* to the oil retention space 25 can be easily secured. Accordingly, a rise in the pressure of the crank chamber 35 can be suppressed to be comparatively low, and oil loss due to leakage of oil O from the lower part of the upper housing 33 can be suppressed.

(5-6)

In the compressor 10 of the present embodiment, the seal ring groove 42*a*, in which the lower shaft seal ring 42 is disposed, is formed on the driveshaft 60.

In the present embodiment, since the seal ring groove 42*a*, in which the lower shaft seal ring 42 is disposed, is provided on the driveshaft 60, the compressor 10, in which the lower shaft seal ring 42 is disposed at the lower shaft seal part 77, can easily be assembled.

(5-7)

In the compressor 10 of the present embodiment, the seal ring groove 41*a*, in which the upper shaft seal ring 41 is disposed, is formed on the driveshaft 60.

In the present embodiment, since the seal ring groove 41*a*, in which the upper shaft seal ring 41 is disposed, is provided on the driveshaft 60, the compressor 10, in which the upper shaft seal ring 41 is disposed at the upper shaft seal part 333, can easily be assembled.

(5-8)

In the compressor 10 of the present embodiment, the discharge rate of the oil discharge pump part 80B is larger than the discharge rate of the oil supply pump part 80A.

Here, discharge rates mean the theoretical discharge rates of the oil supply pump part 80A and of the oil discharge pump part 80B.

In the present embodiment, since the discharge rate of the oil discharge pump part 80B which discharges oil O from the crank chamber 35 is larger than the discharge rate of the oil supply pump part 80A which transports oil O to the crank chamber 35, oil O in the crank chamber 35 can be easily discharged through the oil discharge passage 90. Accordingly, surplus collection of oil O in the crank chamber 35 can be prevented. As a result, a rise in pressure in the crank chamber 35 can be suppressed, and a drop in efficiency of the compressor 10 due to increased power of the oil supply pump part 80A can be prevented.

The discharge rate of the oil discharge pump part 80B can be set to be the same as the discharge rate of the oil supply pump part 80A, or can be set to be smaller than the discharge rate of the oil supply pump part 80A. However, in order to suppress a rise in pressure in the crank chamber 35, it is preferable that the discharge rate of the oil discharge pump part 80B be larger than the discharge rate of the oil supply pump part 80A.

(5-9)

In the compressor of the present embodiment, the oil discharge pump part 80B and the oil supply pump part 80A are positive displacement pumps. The capacity of the displacement chamber V2 of the oil discharge pump part 80B is larger than the capacity of the displacement chamber V of the oil supply pump part 80A.

Since the capacity of the displacement chamber V2 of the oil discharge pump part 80B is larger than the capacity of the displacement chamber V1 of the oil supply pump part 80A, the amount of oil O flowing into the main oil discharge passage 84*c* can be increased, and excessive collection of oil O in the crank chamber 35 can be prevented. As a result, a rise in pressure in the crank chamber 35 can be suppressed to a comparatively low.

The capacity of the displacement chamber V2 of the oil discharge pump part 80B can also be set to be the same as the capacity of the displacement chamber V1 of the oil supply pump part 80A, or can be set to be smaller than the capacity of the displacement chamber V1 of the oil supply pump part 80A. However, in order to suppress a rise in pressure in the crank chamber 35, it is preferable that the capacity of the displacement chamber V2 of the oil discharge pump part 80B be larger than the capacity of the displacement chamber V1 of the oil supply pump part 80A.

(5-10)

In the compressor 10 of the present embodiment, the oil discharge pump part 80B and the oil supply pump part 80A are connected to the lower part of the driveshaft 60 to configure a double pump.

In the present embodiment, since the oil discharge pump part 80B and the oil supply pump part 80A configure a double pump (oil pump 80), the mechanism for supplying/discharging oil O can be made compact, and the compressor 10 thereby can be made compact.

(5-11)

In the compressor 10 of the present embodiment, the area of the inflow passage inlet 67*a* of the first inflow passage 67 that opens into the crank chamber 35 is larger than the area of the inflow passage outlet 67*b* of the first inflow passage 67 that opens into the main oil discharge passage 64*c*. The inflow passage inlet 67*a* is deflected forward in the rotation direction K of the driveshaft 60 than the inflow passage outlet 67*b*.

In the present embodiment, since the area of the inflow passage inlet 67*a* is formed to be larger than the area of the inflow passage outlet 67*b*, and moreover the inflow passage inlet 67*a* is shifted toward the forward side in the rotation direction K of the driveshaft 60, oil O is easily guided to the first inflow passage 67, and oil O in the crank chamber 35 can easily be discharged through the oil discharge passage 90. Accordingly, the occurrence of a state that the pressure in the crank chamber 35 excessively rises due to surplus collection of oil O can be prevented. As a result, a drop in efficiency of the compressor 10 due to increased power of the oil supply pump part 80A can also be suppressed.

The first inflow passage 67 can be configured using only a hole extending in the radial direction from the main oil discharge passage 64*c*. However, in order to prevent the occurrence of a state in which the pressure in the crank chamber 35 due to excessively rises due to surplus collection of oil O, it is preferable that the area of the inflow passage inlet 67*a* be made larger than the area of the inflow passage outlet 67*b*, and that the inflow passage inlet 67*a* be deflected forward in the rotation direction K of the driveshaft 60 than the inflow passage outlet 67*b*.

(5-12)

In the compressor 10 of the present embodiment, the first inflow passage 67 has the intake hole 65 that includes straight parts 65*a* that extends, in plan view, from the inflow passage outlet 67*b* in the direction being along the straight line L and extending to the outside of the driveshaft 60 (the direction B in FIG. 4). The direction B is one example of a first direction. The intake hole 65 is one example of an outlet-vicinity part. In plan view, the centroid Z1 of the inflow passage inlet 67*a* is positioned on the forward side in the rotation direction K of the driveshaft 60 relative to the straight line L that extends in the direction B from the centroid Z2 of the inflow passage outlet 67*b*. The straight line L is one example of a first reference straight line.

In the present embodiment, in plan view, the centroid of the inflow passage inlet 67*a* is disposed on the forward side in the rotation direction K of the driveshaft 60 relative to the straight line L. and therefore the inflow passage inlet 67*a* is deflected forward in the rotation direction K of the driveshaft 60 than the inflow passage outlet 67*b*. As a result, oil O in the crank chamber 35 is easily discharged through the oil discharge passage 90, and surplus collection of oil O in the crank chamber 35 can be prevented.

(5-13)

In the compressor 10 of the present embodiment, the centroid Z of the inflow passage inlet 67*a* is positioned, in plan view, on the forward side in the rotation direction K relative to the straight line L that extends from the rotation center C of the driveshaft 60 through the centroid Z1 of the inflow passage outlet 67*b*. The straight line L is one example of a second reference straight line.

In the present embodiment, in plan view, the centroid Z1 of the inflow passage inlet 67*a* is disposed on the forward side in the rotation direction K of the driveshaft 60 relative to the straight line L. and therefore the inflow passage inlet 67*a* is deflected forward in the rotation direction K of the driveshaft 60 than the inflow passage outlet 67*b*. As a result, oil O in the crank chamber 35 is easily discharged through the oil discharge passage 90, and surplus collection of oil O in the crank chamber 35 can be prevented.

(5-14)

In the compressor 10 of the present embodiment, the first inflow passage 67 has a first surface 66*a* that extends in a direction intersecting the rotation direction K of the driveshaft 60. The first surface 66*a* is one example of a guide surface. In plan view, the first surface 66*a* is parallel to the straight line L.

Since the first inflow passage 67 has the first surface 66*a* as a guide surface being parallel to the straight line L in plan view, oil O in the crank chamber 35 is easily guided to the first inflow passage 67.

Second Embodiment

A compressor 210 according to a second embodiment of the compressor of the present invention is described, referring to the drawings.

(1) Overall Configuration

The compressor 210 according to the second embodiment primally differs from the compressor 10 according to the first embodiment in that a balance weight 100, installed on a driveshaft 260, is disposed within the crank chamber 35, and in that a part of an oil discharge passage 290 is formed in the balance weight 100. Besides these, the compressor 210 is substantially similar to the compressor 10.

In the second embodiment, among the members, configuration and the like of the compressor 210, the members, configuration and the like that are similar to those of the compressor 10 according to the first embodiment are assigned with the same reference signs as the members, configurations and the like of the compressor 10 according to the first embodiment. Among the members, configuration and the like of the compressor 210, descriptions for the members, configuration and the like that are similar to those of the compressor 10 according to the first embodiment are omitted. Similar members, configurations and the like include not only those members, configurations and the like with completely the same shapes, functions and the like, but also those members, configurations and the like that are substantially the same.

(2) Detailed Configuration

Among the members, configurations and the like of the compressor 210, a driveshaft 260 and an oil discharge passage 290 which differ from those in the compressor 10 of the first embodiment, will be described in detail.

(2-1) Driveshaft

The driveshaft 260 differs from the driveshaft 60 of the first embodiment in that a balance weight 100 is installed adjacent to the pin shaft 61 below the pin shaft 61.

Figure 11:
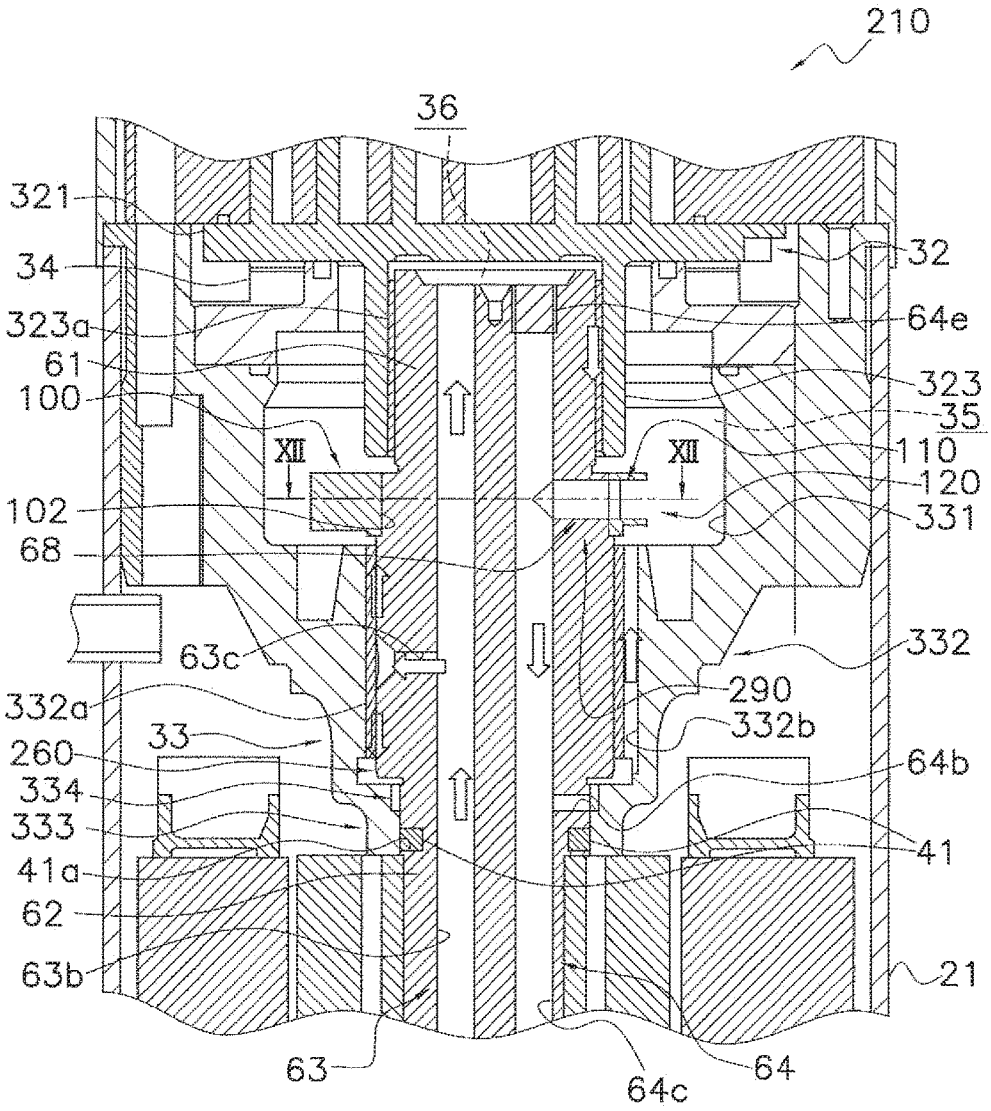
FIG. 11 is a schematic vertical cross-sectional view of the periphery of the crank chamber of a compressor according to a second embodiment of the present invention.

The balance weight 100 is installed on the driveshaft 260 in the crank chamber 35 (see FIG. 11). The balance weight 100 is a hollow member with a hole 102 opened in the center part, and the driveshaft 260 and the balance weight 100 are connected in a state in which the driveshaft 260 is inserted into the hole (see FIG. 11).

Figure 14:
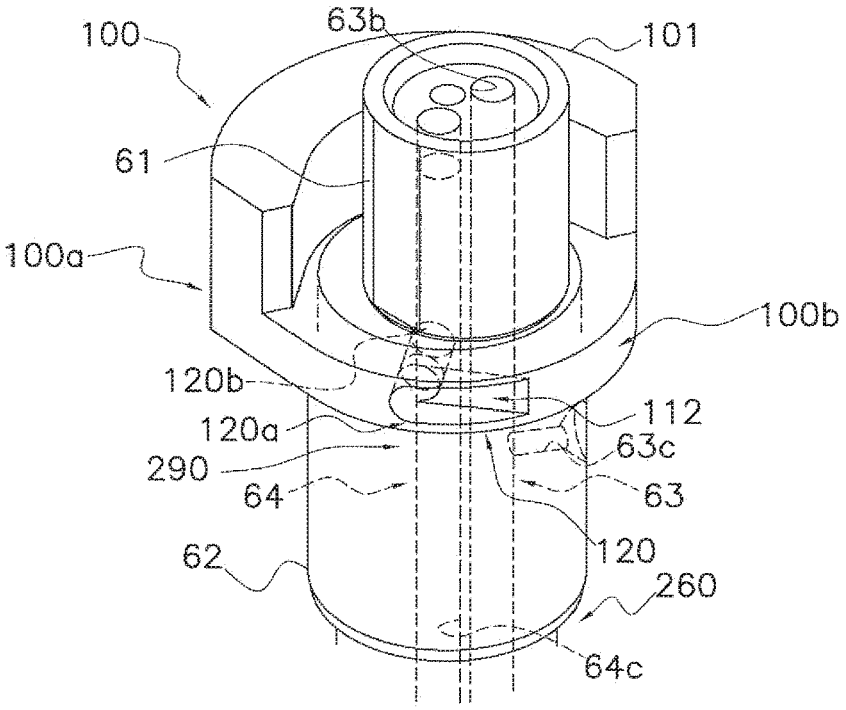
FIG. 14 is a perspective view of an upper part of the driveshaft of the compressor of FIG. 11, illustrating the in-shaft oil supply passage and the in-shaft oil discharge passage formed in the driveshaft, and the in-weight inflow passage formed in the balance weight, with dashed lines.

The balance weight 100 includes a large-radius part 100*a* on which a weight body 101 is arranged, and a small-radius part 100*b* (see FIG. 14). In plan view, the radius R2 of the small-radius part 100*b* relative to the rotation center C (the center of the hole 102) of the driveshaft 260 is formed to be smaller than the radius R1 of the large-radius part 100*a* relative to the rotation center C (the center of the hole 102) of the driveshaft 260 (see FIG. 12). In plan view, the large-radius part 100*a* is arranged on one end side of the balance weight 100, and the small-radius part 100*b* is arranged on the other end side of the balance weight 100, so as to enclose the hole 102 between the large-radius part 100*a* and the small-radius part 100*b* (see FIG. 12).

Figure 13:
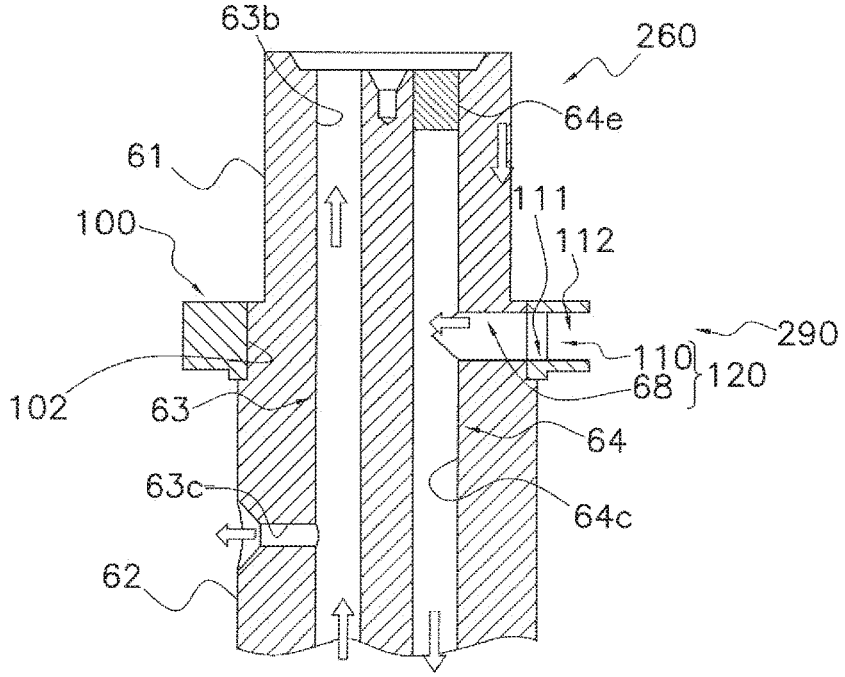
FIG. 13 is a schematic vertical cross-sectional view of an upper part of the driveshaft of the compressor of FIG. 11, FIG. 13 illustrating a vertical cross-section obtained by sectioning the driveshaft at a straight line M and a straight line M' in FIG. 12.

Further, the driveshaft 260, differs in that the intake hole 68 of the first inflow passage 120 of the oil discharge passage 290 is formed in the main shaft 62 from the driveshaft 60 of the first embodiment, in which the intake hole 65 of the first inflow passage 67 of the oil discharge passage 90 is formed in the pin shaft 61 (see FIG. 13).

Figure 12:
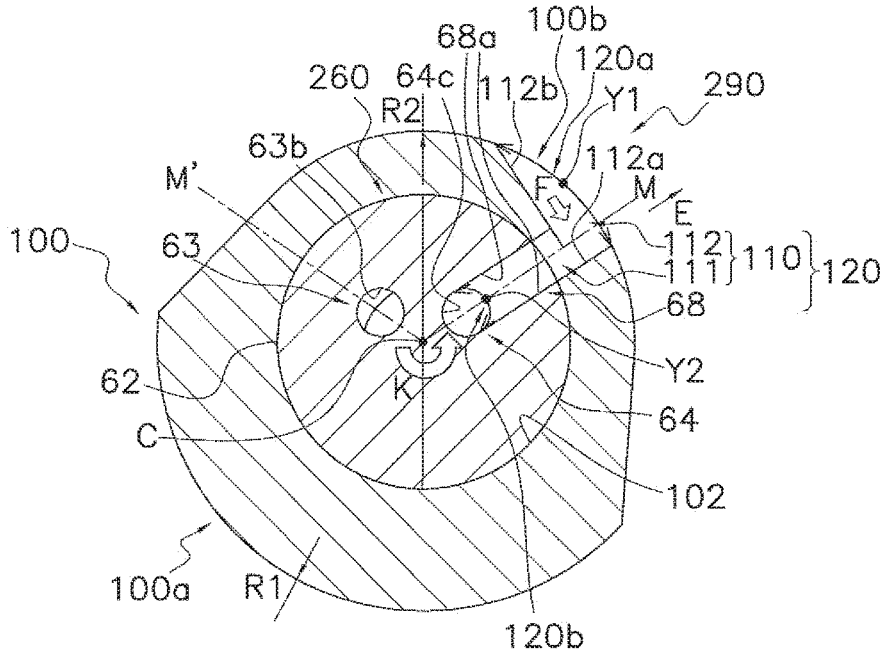
FIG. 12 is a cross-sectional view viewing from the arrow direction of XII-XII in FIG. 11, in which an inflow passage inlet is formed in a small-radius part of a balance weight.

Further, the driveshaft 260 differs in that the introduction part 112 of the first inflow passage 120 of the oil discharge passage 290 is formed in the balance weight 100, from the driveshaft 60 of the first embodiment, in which the introduction part 66 of the first inflow passage 67 of the oil discharge passage 90 is formed in the driveshaft 60 (see FIG. 12).

In other respects, the driveshaft 260 of the second embodiment is similar to the driveshaft 60 of the first embodiment, and therefore descriptions are omitted.

(2-2) Oil Discharge Passage

The oil discharge passage 290 is an oil passage that leads oil O in the crank chamber 35 and the oil-recovery space 334, and oil O that has been supplied to the lower bearing 71, to the oil discharge pump part 80B of the oil pump 80. The oil discharge passage 290 primally includes the in-shaft oil discharge passage 64, an in-weight inflow passage 110 (see FIG. 12), the in-lower-housing oil discharge passage 74, and the lower space 78 that is surrounded by the recess 72 of the lower housing 70 and the oil pump 80. The in-lower-housing oil discharge passage 74 and the lower space 78 are similar to those in the first embodiment, and so descriptions are omitted.

The in-weight inflow passage 110 is provided in the small-radius part 100*b* of the balance weight 100 (see FIG. 12). That is, the in-weight inflow passage 110 is formed in the small-radius part 100*b* of the balance weight 100 (see FIG. 12).

The in-shaft oil discharge passage 64 and the in-weight inflow passage 110 lead oil O in the crank chamber 35 to the annular space 76 in toroidal shape formed around the main shaft 62 of the driveshaft 60. The in-shaft oil discharge passage 64 also leads oil O in the oil-recovery space 334 to the annular space 76 in toroidal shape formed around the main shaft 62 of the driveshaft 60. Oil O in the annular space 76 is transported through the in-lower-housing oil discharge passage 74 to the lower space 78 (see FIG. 11). Oil O that collects in the crank chamber 35 includes oil O that has been supplied to the sliding part between the pin shaft 61 of the driveshaft 60 and the bearing metal 323*a* of the pin bearing 323. Oil O that collects in the crank chamber 35 includes oil O that flows into the crank chamber 35 through the upper bearing oil discharge passage 332*b* after being supplied to the sliding part between the main shaft 62 of the driveshaft 60 and the bearing metal 332*a* of the upper bearing 332. Oil O that collects in the oil-recovery space 334 includes oil O that has been supplied to the sliding part between the main shaft 62 of the driveshaft 60 and the bearing metal 332*a* of the upper bearing 332. Oil O that flows into the annular space 76 includes oil O that has flowed through the in-shaft oil discharge passage 64, and a part of the oil O that has been supplied to the sliding part between the main shaft 62 of the driveshaft 60 and the bearing metal 71*a* of the lower bearing 71.

The in-shaft oil discharge passage 64 primally has the intake hole 68 (see FIG. 12 and FIG. 13), the main oil discharge passage 64*c*, the second inflow passage 64*b*, and the outflow passage 64*d*. The in-weight inflow passage 110 primally has a communication passage 111, and the introduction part 112 (see FIG. 12 and FIG. 13). The intake hole 68, communication passage 11*l*, and introduction part 112 constitute the first inflow passage 120 (see FIG. 12 and FIG. 13).

The first inflow passage 120 communicates between the main oil discharge passage 64*c* and the crank chamber 35 (see FIG. 11). The upper part of the driveshaft 60 and the balance weight 100 are disposed in the crank chamber 35, which is formed by the upper housing 33, but in the present embodiment, the space in the first inflow passage 120 is defined as space that is different from the crank chamber 35.

The main oil discharge passage 64*c*, the second inflow passage 64*b*, and the outflow passage 64*d* are similar to those in the first embodiment, and so descriptions are omitted. The first inflow passage 120 is described in detail below.

The intake hole 68 is one example of an outlet-vicinity part. The intake hole 68 is a hole that opens into the main oil discharge passage 64*c* (see FIG. 12 and FIG. 13). The opening of the intake hole 68 into the main oil discharge passage 64*c* is referred to as the inflow passage outlet 120*b* (see FIG. 12, FIG. 14 and FIG. 15). That is, the intake hole 68 is provided near the inflow passage outlet 120*b*, and more specifically, adjacent to the inflow passage outlet 120*b*. The inflow passage outlet 120*b* is an opening formed in the outer peripheral edge of the main oil discharge passage 64*c*. In other words, if it were supposed that the main oil discharge passage 64*c* was a solid cylindrical member, the inflow passage outlet 120*b* would be the opening formed on the outer peripheral surface of the cylindrical member by opening the intake hole 68. In plan view, the inflow passage outlet 120*b* is disposed on the outer peripheral edge of the main oil discharge passage 64*c*, in the interval indicated by the double-headed arrow in FIG. 12.

The intake hole 68 extends in a straight line from the main oil discharge passage 64*c*, or in other words, from the inflow passage outlet 120*b*. The intake hole 68 is a hole formed in a circular shape in a side view (a direction perpendicular to the axial direction of the driveshaft 260) (see FIG. 15). Accordingly, the inflow passage outlet 120*b* is also formed in a circular shape in a side view (see FIG. 15).

The intake hole 68 extends along a straight line that intersects the axial direction of the driveshaft 260. In particular, in the present embodiment, the intake hole 68 extends along a straight line that is perpendicular to the axial direction of the driveshaft 260. More specifically, in plan view, the intake hole 68 extends along a straight line M that passes through the rotation center C of the driveshaft 260 (the center of the main shaft 62) and the centroid Y2 of the inflow passage outlet 120*b* and is perpendicular to the axial direction of the driveshaft 260 (see FIG. 12). In the present embodiment, the centroid Y2 of the inflow passage outlet 120*b* in plan view means the centroid of an imagined figure, which is an imagined figure of small width extending along the outer peripheral edge of the main oil discharge passage 64*c* in the interval of the outer peripheral edge of the main oil discharge passage 64*c* in which the inflow passage outlet 120*b* is disposed (the interval of the outer peripheral edge of the main oil discharge passage 64*c* indicated by the double-headed arrow in FIG. 12).

In plan view, the intake hole 68 has a pair of straight parts 68*a* extending in straight lines from the inflow passage outlet 67*b* (see FIG. 12). Both straight parts 68*a* extend from the inflow passage outlet 120*b* parallel to the straight line M toward the outside of the main shaft 62 (see the direction of the arrow E in FIG. 12).

The communication passage 111 is a hole extending in a straight line. The communication passage 111 communicates with the intake hole 68 on one end, and with the introduction part 112 on the other end. That is, the communication passage 111 is a passage which communicates between the intake hole 68 and the introduction part 112. The communication passage 111 is a hole that, in a side view (in a direction perpendicular to the axial direction of the driveshaft 260), is formed in a circular shape (see FIG. 15). The diameter of the hole of the communication passage 111 is the same as the diameter of the hole of the intake hole 68. The intake hole 68 and the communication passage 111 extend continuously. That is, in plan view, the communication passage 111 extends along the straight line M (see FIG. 12).

The introduction part 112 is formed so as to core out the interior of the balance weight 100 from the outer peripheral surface of the balance weight 100, and in particular, so as to core out the interior of the small-radius part 100*b* of the balance weight 100 (see FIG. 14). The introduction part 112 is a space that, in plan view, is surrounded by the outer peripheral edge of the balance weight 100 (the interval, indicated by the double-headed arrow in FIG. 12, in which the inflow passage inlet 120*a*, described later, is formed), a first surface 112*a* which extends continuously from one of the straight parts 68*a* of the intake hole 68, a second surface 112*b* which extends in a direction perpendicular to the straight line M, and the communication passage 111. In plan view, the introduction part 112 is formed so as to extend longer in a direction perpendicular to the straight line M (a direction in which the second surface 112*b* extends) than the direction of the straight line M (a direction in which the first surface 112*a* extends) (see FIG. 12).

The introduction part 112 is a space that communicates with the intake hole 68 via the communication passage 111 (see FIG. 12 and FIG. 13). The introduction part 112 is also a space that communicates with the crank chamber 35 (see FIG. 12 and FIG. 13). In other words, the introduction part 112 opens into the crank chamber 35. The opening of the introduction part 112 into the crank chamber 35 is referred to as the inflow passage inlet 120*a* (see FIG. 12, FIG. 14 and FIG. 15). The inflow passage inlet 120*a* is an opening formed in the outer peripheral edge of the balance weight 100 (see FIG. 14). In plan view, the inflow passage inlet 120*a* is disposed in the interval on the outer peripheral edge of the balance weight 100 indicated by the double-headed arrow in FIG. 12. In a side view from the direction facing the second surface 112*b* of the introduction part 112, the inflow passage inlet 120*a* is formed in a rectangular shape with long sides that extends in the horizontal direction (see FIG. 15). The oil O in the crank chamber 35 flows into the introduction part 112 through the inflow passage inlet 120*a*.

There are the following relations obtain between the inflow passage inlet 120*a* that is the inlet for oil O from the crank chamber 35 into the first inflow passage 120 (the inflow passage inlet 120*a* that opens into the crank chamber 35), and the inflow passage outlet 120*b* that is the outlet for oil O from the first inflow passage 120 to the main oil discharge passage 64*c* (the inflow passage outlet 120*b* that opens into the main oil discharge passage 64*c*).

Figure 15:
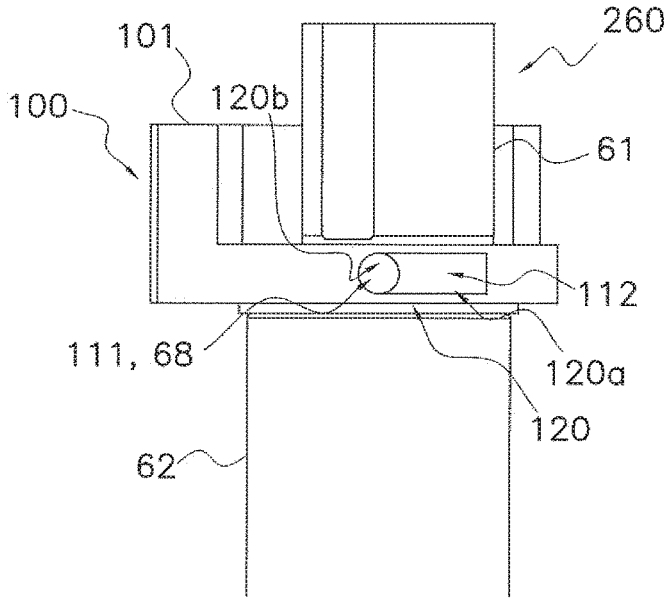
FIG. 15 is a view of an upper part of the driveshaft of the compressor of FIG. 11 viewing from a side.

1) The area of the inflow passage inlet 120*a* that is formed on the outer peripheral surface of the balance weight 100 is larger than the area of the inflow passage outlet 120*b* formed on the outer peripheral edge of the main oil discharge passage 64*c* (see FIG. 14 and FIG. 15).

2) The inflow passage inlet 120*a* is deflected forward in the rotation direction K of the driveshaft 260 than the inflow passage outlet 120*b*. In other words, in plan view, the centroid Y1 of the inflow passage inlet 120*a* is positioned on the forward side in the rotation direction K of the driveshaft 260 relative to the straight line M that passes through the centroid Y2 of the inflow passage outlet 120*b* and extends in the direction E (see FIG. 12). In the present embodiment, the centroid Y1 of the inflow passage inlet 120*a* in plan view means the centroid of an imagined figure, which is an imagined figure of small width extending along the outer peripheral edge of the balance weight 100 in the interval where the inflow passage inlet 120*a* is disposed at the outer peripheral edge of the balance weight 100 (the interval of the outer peripheral edge of the balance weight 100 indicated by the double-headed arrow in FIG. 12). In other words, in plan view, the centroid Y of the inflow passage inlet 120*a* is positioned on the forward side in the rotation direction K of the driveshaft 260 relative the straight line M that extends from the rotation center C of the driveshaft 260 through the centroid Y2 of the inflow passage outlet 120*b* (see FIG. 12).

Since the inflow passage inlet 120*a* is configured to have an area larger than the area of the inflow passage outlet 120*b* as described in 1) above, oil O in the crank chamber 35 is easily guided to the main oil discharge passage 64*c* by the first inflow passage 120 compared with a case in which the area of the inflow passage inlet 120*a* is not larger than the area of the inflow passage outlet 120*b*.

Further, since the inflow passage inlet 120*a* is deflected forward in the rotation direction K of the driveshaft 260 than the inflow passage outlet 120*b* as described in 2) above, when the driveshaft 260 rotates, oil O is easily guided into the first inflow passage 120 from the inflow passage inlet 120*a*, which is disposed forward side in the rotation direction K than the inflow passage outlet 120*b*, and oil O is easily guided into the main oil discharge passage 64*c*.

In particular, in the present embodiment, the introduction part 112 has the first surface 112*a* that extends in a direction intersecting the rotation direction K. The first surface 112*a* is one example of a guide surface. In plan view, the first surface 112*a* is a linear extension of the straight part 68*a* of the intake hole 68 on the rearward side in the rotation direction K of the driveshaft 260 (the straight part 68*a* of the intake hole 68 further on the rearward side in the rotation direction K than the straight line M) (see FIG. 12). That is, the introduction part 112 has a first surface 112*a* that extends parallel to the straight line M. When the driveshaft 60 rotates in the rotation direction K, oil O flows in the direction opposite the rotation direction K (the direction F in FIG. 13) in the introduction part 112, the direction is changed by the first surface 112*a*, and oil O is guided to the communication passage 111, the intake hole 68, and then to the main oil discharge passage 64*c*.

In the present embodiment, the intake hole 68 and the communication passage 111 are formed with a drill, and thereafter the introduction part 112 is formed with an end mill. However, the formation methods of the intake hole 68, communication passage 111 and introduction part 112 are merely examples, and the invention is not limited thereto. Various machining methods can be applied as formation methods of the intake hole 68, the communication passage 111 and the introduction part 112.

(3) Operating Action

The basic operating action of the compressor 210 is similar to that of the compressor 10, and therefore a description is omitted.

(4) Oil Supply/Discharge Action

Action to discharge oil O in the compressor 210 is described. Action to supply oil O in the compressor 210 is similar to the action to supply oil O in the compressor 10 of the first embodiment, and so a description is omitted.

When the compressor 210 is operated and the driveshaft 260 rotates, the oil discharge pump part 80B of the oil pump 80 is also driven. Specifically, rotation of the oil pump shaft 84 which is connected to the driveshaft 60 causes the upper-side inner rotor 88 to rotate within the upper-side outer rotor 87. As a result, the volume of the displacement chamber V2 of the oil discharge pump part 80B expands and contracts, and oil O in the crank chamber 35 flows from the inflow passage inlet 120*a* into the introduction part 112. Oil O that has flowed into the introduction part 112 is guided by the first surface 112*a*, passes through the communication passage 111, and flows into the intake hole 68. Oil O passes through the intake hole 68 and flows into the main oil discharge passage 64*c*. Oil O in the oil-recovery space 334 passes through the second inflow passage 64*b* and flows into the main oil discharge passage 64*c*. Oil O that has flowed from the first inflow passage 67 and the second inflow passage 64*b* into the main oil discharge passage 64*c* moves downward in the main oil discharge passage 64*c*, passes through the outflow passage 64*d*, and flows out to the annular space 76. Oil O that has flowed into the annular space 76 passes through the in-lower-housing oil discharge passage 74 and flows into the lower space 78 the sides of which are surrounded by the recess 72 of the lower housing 70. Oil O in the lower space 78 passes through the discharge outlet 73*a* formed in the thrust plate 73 and flows into the oil discharge pump part 80B of the oil pump 80. More specifically, oil O that has passed through the discharge outlet 73*a* flows into the in-body upper-side passage 81*b*, and is drawn into the displacement chamber V2 within the in-body upper-side passage 81*b*. Oil O discharged from the displacement chamber V2 passes through the oil discharge channel 81*e* formed within the pump body 81, and is discharged to the oil retention space 25 at the bottom of the casing 20.

(5) Features

The compressor 210 of the second embodiment has features similar to the features described in (5-1) to (5-10) of the first embodiment. Moreover, the compressor 210 of the second embodiment has the following features.

(5-1)

In the compressor 210 of the present embodiment, the area of the inflow passage inlet 120*a* of the first inflow passage 120 that opens into the crank chamber 35 is larger than the area of the inflow passage outlet 120*b* of the first inflow passage 120 that opens into the main oil discharge passage 64*c*. The inflow passage inlet 120*a* is deflected forward in the rotation direction K of the driveshaft 260 than the inflow passage outlet 120*b*.

The area of the inflow passage inlet 120*a* is formed to be larger than the area of the inflow passage outlet 120*b*, and moreover the inflow passage inlet 120*a* is shifted toward the forward side in the rotation direction K of the driveshaft 260, and therefore oil O is easily guided to the first inflow passage 120, and oil O in the crank chamber 35 is easily discharged through the oil discharge passage 290. Accordingly, surplus collection of oil O in the crank chamber 35 can be prevented. As a result, a drop in efficiency of the compressor 210 due to increased power of the oil supply pump part 80A can be suppressed.

The first inflow passage 120 can also be configured using only a hole that extends in a radial direction from the main oil discharge passage 64*c*. However, in order to prevent the occurrence of a state in which there is surplus collection of oil O and the pressure in the crank chamber 35 rises excessively, it is preferable that the area of the inflow passage inlet 120*a* be larger than the area of the inflow passage outlet 120*b*, and that the inflow passage inlet 120*a* be deflected forward in the rotation direction K of the driveshaft 260 than the inflow passage outlet 120*b*.

(5-2)

In the compressor 210 of the present embodiment, the first inflow passage 120 has the intake hole 68 that includes a straight part 68*a* that extends, in plan view, from the inflow passage outlet 120*b* along the straight line M to the outside of the driveshaft 260 (extends in the direction E in FIG. 12). The direction E is one example of a first direction. The intake hole 68 is one example of an outlet-vicinity part. In plan view, the centroid Y1 of the inflow passage inlet 120*a* is positioned on the forward side in the rotation direction K of the driveshaft 260 relative to the straight line M that extends in the direction E from the centroid Y2 of the inflow passage outlet 120*b*. The straight line M is one example of a first reference straight line.

In the present embodiment, in plan view, the centroid Y1 of the inflow passage inlet 120*a* is disposed on the forward side in the rotation direction K of the driveshaft 260 relative to the straight line M, and therefore the inflow passage inlet 120*a* is deflected forward in the rotation direction K of the driveshaft 260 than the inflow passage outlet 120*b*. Accordingly, oil O in the crank chamber 35 is easily discharged through the oil discharge passage 290, and surplus collection of oil O in the crank chamber 35 can be prevented.

(5-3)

In the compressor 210 of the present embodiment, in plan view, the centroid Y1 of the inflow passage inlet 120*a* is positioned on the forward side in the rotation direction K of the driveshaft 260 relative to the straight line M that extends from the rotation center C of the driveshaft 260 through the centroid Y2 of the inflow passage outlet 120*b*. The straight line M is one example of a second reference straight line.

In the present embodiment, in plan view, the centroid Y1 of the inflow passage inlet 120*a* is disposed on the forward side in the rotation direction K of the driveshaft 260 relative to the straight line M, and therefore the inflow passage inlet 120*a* is deflected forward in the rotation direction K of the driveshaft 260 than the inflow passage outlet 120*b*. Accordingly, oil O in the crank chamber 35 is easily discharged through the oil discharge passage 290, and surplus collection of oil O in the crank chamber 35 can be prevented.

(5-4)

In the compressor 210 of the present embodiment, the first inflow passage 120 has a first surface 112*a* that extends in a direction intersecting the rotation direction K of the driveshaft 260. The first surface 112*a* is one example of a guide surface. In plan view, the first surface 112*a* is parallel to the straight line M.

Since the first inflow passage 120 has the first surface 112*a* as a guide surface being parallel to the straight line M in plan view, oil O in the crank chamber 35 is easily guided to the first inflow passage 120.

(5-5)

The compressor 210 of the present embodiment is provided with the balance weight 100 that is installed on the driveshaft 260 in the crank chamber 35. The first inflow passage 120 includes the intake hole 68 as one example of an in-shaft inflow passage and the in-weight inflow passage 110. The intake hole 68 is formed in the driveshaft 260. The in-weight inflow passage 110 is formed in the balance weight 100, communicates with the intake hole 68, and opens into the crank chamber 35.

The in-weight inflow passage 110 opens into the crank chamber 35, and the inflow passage inlet 120*a* is provided in the balance weight 100. Therefore, it is possible to secure a large cross-sectional for the inflow passage inlet 120*a* without reducing the strength of the driveshaft 260.

(5-6)

In the compressor 210 of the present embodiment, the balance weight 100 includes the large-radius part 100*a* on which the weight body 101 is arranged, and the small-radius part 100*b*. In plan view, the small-radius part 100*b* is formed to have a radius relative to the rotation center C of the driveshaft 260 that is smaller than that of the large-radius part 100*a*. The inflow passage inlet 120*a* is arranged in the small-radius part 100*b*.

Since the inflow passage inlet 120*a* is formed in the small-radius part 100*b*, the inflow passage inlet 120*a*, with a larger area than the inflow passage outlet 120*b*, can be provided in the balance weight 100, while prioritizing the original function of the balance weight 100 (the function of achieving rotational balance of the driveshaft 260).

<Modifications>

Below, modifications of the above embodiments are presented. A plurality of modifications may be combined insofar as there are no inconsistencies.

(1) Modification A

In the above first and second embodiments, a dual positive displacement pump is used as an oil supply pump and an oil discharge pump, but such an arrangement is not provided by way of limitation.

For example, the oil supply pump and oil discharge pump need not to be a double pump. However, by using a double pump for the oil supply pump and the oil discharge pump, the compressors 10 and 210 can easily be made compact.

Further, another type pump other than a positive displacement pump may be used as the oil supply pump and/or the oil discharge pump. For example, a differential pressure pump or a centrifugal pump may be used as the oil supply pump and/or the oil discharge pump.

(2) Modification B

In the above embodiments, the oil discharge passages 90 and 290 have the lower space 78 that is surrounded by the recess 72 of the lower housing 70, and oil O in the lower space 78 passes through the discharge outlet 73*a* formed in the thrust plate 73 and is led to the oil discharge pump part 80B. However, the configurations of the oil discharge passages 90 and 290 are examples, and the invention is not limited thereto.

For example, the oil discharge passages 90 and 290 may be configured such that oil O flows directly (without passing through a lower space 78) into the oil discharge pump part 80B from a discharge opening formed in the thrust plate 73 through the in-lower-housing oil discharge passage 74 formed in the lower housing 70. Or, for example, a configuration may be used in which oil O in the lower space 78 flows from the insertion hole 73*b* formed in the thrust plate 73 into the oil discharge pump part 80B.

(3) Modification C

In the above second embodiment, the inflow passage inlet 120*a* is formed in the small-radius part 100*b* of the balance weight 100, but such an arrangement is not provided by way of limitation.

Figure 16:
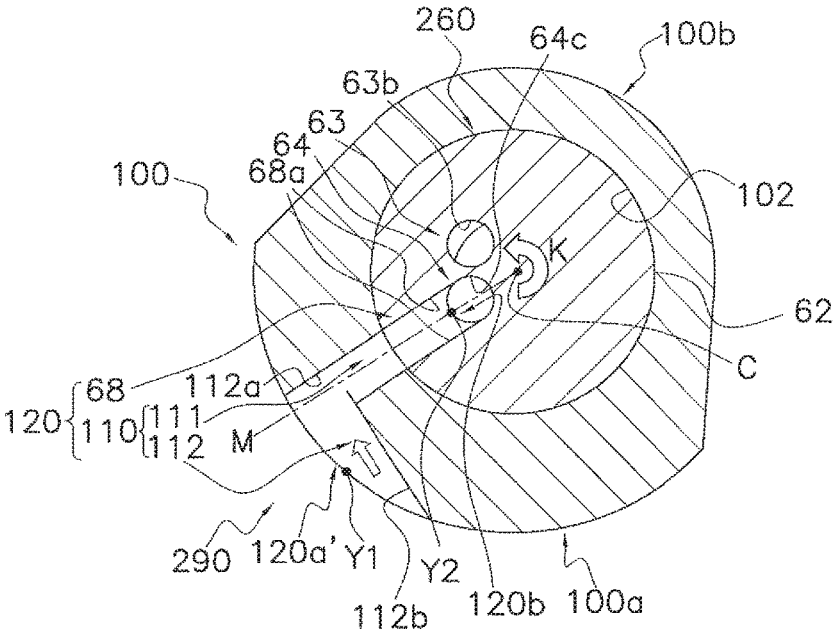
FIG. 16 is one example of a cross-sectional view of the driveshaft of a compressor according to a modified example C, illustrating a cross-sectional view of a portion in which an inflow passage is formed, in which the inflow passage inlet is formed in a large-diameter part of the balance weight.

For example, as shown in FIG. 16, an inflow passage inlet 120*a*' may be arranged in the large-radius part 100*a* of the balance weight 100. In addition, the oil discharge passage 290 may be configured so as to have features similar to those of the second embodiment, other than those related to the position of the inflow passage inlet 120*a*'. By arranging the inflow passage inlet 120*a*' in the large-radius part 100*a* of the balance weight 100, a large cross-section can be more easily secured for the inflow passage inlet 120*a*, and surplus collection of oil O in the crank chamber 35 is more easily prevented compared with a case in which the inflow passage inlet 120*a* is arranged in the small-radius part 100*b*.

Figure 17:
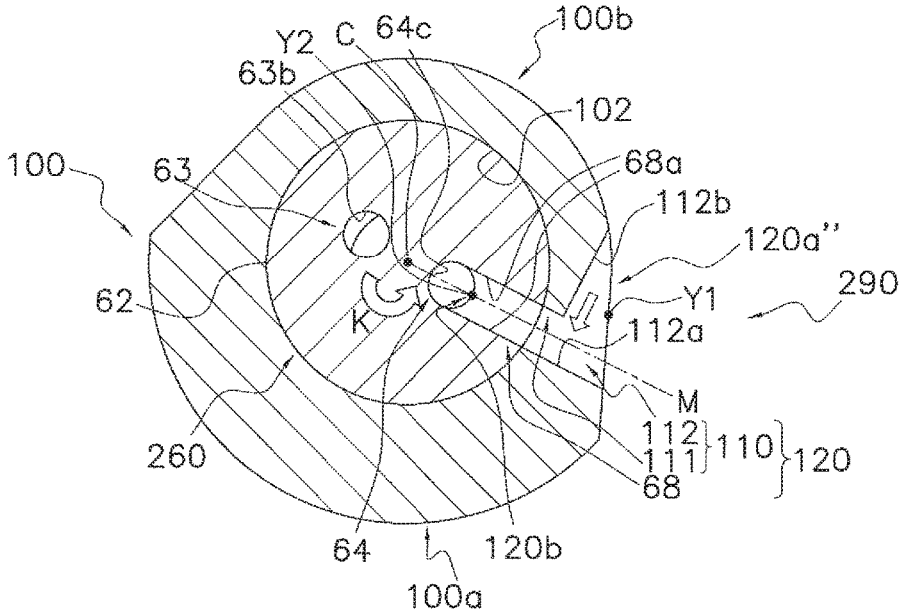
FIG. 17 is one example of a cross-sectional view of the driveshaft of the compressor according to modified example C, illustrating a cross-sectional view of a portion in which an inflow passage is formed, in which the inflow passage inlet is formed at a boundary part between a large-diameter part and a small-diameter part of the balance weight.

Further, for example, as shown in FIG. 17, an inflow passage inlet 120*a*" may be arranged at the boundary between the small-radius part 100*b* and the large-radius part 100*a* of the balance weight 100. The oil discharge passage 290 may be configured so as to have features similar to those of the second embodiment, other than those related to the position of the inflow passage inlet 120*a*".

Further, for example, the inflow passage inlet may be formed across the small-radius part 100*b* and the boundary between the small-radius part 100*b* and the large-radius part 100*a*, or across the large-radius part 100*a* and the boundary between the small-radius part 100*b* and the large-radius part 100*a*. The oil discharge passage 290 may be configured so as to have features similar to those of the second embodiment, other than those related to the position of the inflow passage inlet.

(4) Modification D

In the above second embodiment, the intake hole 68 and the communication passage 111 extend in straight lines, but such an arrangement is not provided by way of limitation.

Figure 18:
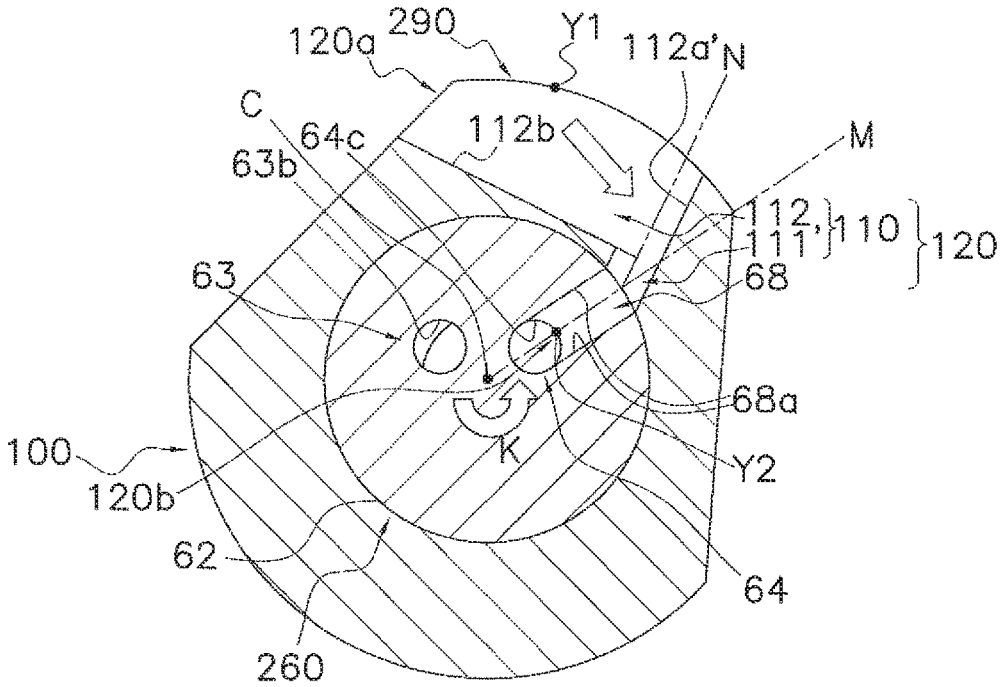
FIG. 18 is a cross-sectional view of the driveshaft of a compressor according to a modified example D.

For example, as shown in FIG. 18, a communication passage 111' may be formed discontinuously with the intake hole 68 (such that the intake hole 68 and the communication passage 111' are not aligned on a straight line). In FIG. 18, the communication passage 111' is formed so as to extend, in plan view, along a straight line N that is inclined further to the forward side in the rotation direction K of the driveshaft 260 than the straight line M. In the configuration of FIG. 18, a first surface 112*a*' of the introduction part 112 extends along the straight line N. That is, the first surface 112*a*' is inclined further to the leading side in the rotation direction K of the driveshaft 260 than the straight line M as the second reference straight line. When formed in this way, oil O in the crank chamber 35 is easily guided to the first inflow passage 120.

(5) Modification E

In plan view, the intake hole 65 in the above first embodiment has the straight parts 65*a*, and the intake hole 68 of the above second embodiment has the straight parts 68*a*, but such an arrangement is not provided by way of limitation. The intake hole 65 and/or the intake hole 68 may be configured with curved lines in plan view.

(6) Modification F

In the above first embodiment, the first inflow passage 67 is formed in the pin shaft 61, but such an arrangement is not provided by way of limitation; a configuration may be used in which the first inflow passage 67 is formed in the main shaft 62.

(7) Modification G

The shapes of each of the parts of the oil discharge passage 90 of the above first embodiment and of the oil discharge passage 290 of the above second embodiment are given as examples, but such an arrangement is not provided by way of limitation. The shapes of each of the parts may be determined appropriately, considering ease of machining and the like.

For example, in the above first embodiment, the main oil discharge passage 64*c* and the intake hole 65 are circular holes, and in the above second embodiment, the main oil discharge passage 64*c*, intake hole 68, and communication passage 111 are circular holes; but the shapes of the holes are examples; e.g., a quadrilateral configuration, ellipsoidal configuration, or other configuration may be used.

Further, for example in the above first embodiment, the first surface 66*a* of the introduction part 66 extends in a straight line in plan view, and in the above second embodiment, the first surface 112*a* of the introduction part 112 extends in a straight line in plan view, but configurations may be used in which the first surface 66*a* and the first surface 112*a* extend curvilinearly in plan view.

(8) Modification H

In the above first embodiment, the intake hole 65 extends in a direction perpendicular to the axial direction of the driveshaft 60 (extends in a horizontal direction), and in the above second embodiment, the intake hole 68 extends in a direction perpendicular to the axial direction of the driveshaft 260 (extends in a horizontal direction), but such an arrangement is not provided by way of limitation.

The intake hole 65 and the intake hole 68 may extend in a direction that intersects the axial direction of the driveshaft 60, and the intake hole 65 and/or the intake hole 68 may for example be formed to extend in an oblique direction.

The same may be applied for the introduction part 66 of the above first embodiment, and for the communication passage 111 and introduction part 112 of the above second embodiment.

(9) Modification I

In the above first embodiment and second embodiment, as the inflow passage inlet/inflow passage outlet appears to be disposed on a line in plan view, an imagined figure of small width extending along the inflow passage inlet/inflow passage outlet is imagined, and the centroid thereof is determined. However, the invention is not limited thereto.

For example, if the inflow passage inlet/inflow passage outlet does not overlap on a line in plan view, then the centroid of a region surrounded by lines corresponding to the inflow passage inlet/inflow passage outlet in plan view may be determined as the centroid of the inflow passage inlet/inflow passage outlet.

INDUSTRIAL APPLICABILITY

The present invention pertains to a compressor in which an oil discharge passage for discharging oil from a crank chamber is formed in a driveshaft, and is advantageous as a compressor that can prevent a state in which oil collects in the crank chamber, and the pressure in the crank chamber rises excessively.

What is claimed is:

1. A compressor, comprising:

a casing with an oil retention space being formed at a bottom of the casing;

an electric motor accommodated in the casing;

a driveshaft extending vertically and connected to the electric motor;

a compression mechanism, accommodated in the casing, and having a movable part connected to the driveshaft to be driven by the electric motor, and an upper housing forming a crank chamber internally accommodating a connecting portion that connects an eccentric part of the driveshaft and the movable part, and the upper housing having an upper bearing that pivotally supports the driveshaft below the crank chamber;

an oil supply passage leading oil in the oil retention space to the crank chamber, the oil supply passage being formed in the driveshaft;

an oil discharge passage including a main oil discharge passage that extends in an axial direction in the driveshaft, and a first inflow passage communicating between the main oil discharge passage and the crank chamber;

an oil supply pump configured to supply oil in the oil retention space to the oil supply passage; and an oil discharge pump configured to discharge oil in the crank chamber to the oil retention space via the oil discharge passage, an oil-recovery space being formed in a lower part of the upper housing below the crank chamber, the oil discharge passage further including a second inflow passage communicating between the main oil discharge passage and the oil-recovery space, and an discharge rate of the oil discharge pump being larger than a discharge rate of the oil supply pump.

2. The compressor according to claim 1, wherein the oil discharge pump and the oil supply pump are positive displacement pumps, and a capacity of the oil discharge pump is larger than a capacity of the oil supply pump.

3. The compressor according to claim 1, wherein the oil discharge pump and the oil supply pump are connected to a lower part of the driveshaft to form a double pump.

4. The compressor according to claim 1, wherein the oil-recovery space is formed below the upper bearing.

5. The compressor according to claim 1, wherein the upper housing further has an upper shaft seal part disposed below the oil-recovery space, and an upper shaft seal ring is disposed at the upper shaft seal part.

6. The compressor according to claim 5, further comprising a lower housing disposed below the electric motor and having a lower bearing pivotally supporting the driveshaft and a lower shaft seal part disposed above the lower bearing; and a lower shaft seal ring disposed at the lower shaft seal part.

7. The compressor according to claim 6, wherein an annular space is formed so as to surround the driveshaft and communicate with the main oil discharge passage, and the annular space is disposed below the lower shaft seal, and a lower housing oil passage is formed in the lower housing, and the lower housing oil passage communicates between the annular space and the oil retention space.

8. The compressor according to claim 6, wherein a groove is formed on the driveshaft, and the lower shaft seal ring is disposed in the groove.

9. The compressor according to claim 5, wherein a groove is formed on the driveshaft, and the upper shaft seal ring is disposed in the groove.

10. A compressor comprising:

a casing with an oil retention space being formed at a bottom of the casing;

an electric motor accommodated in the casing;

a driveshaft extending vertically and connected to the electric motor;

a compression mechanism, accommodated in the casing, and having a movable part connected to the driveshaft to be driven by the electric motor, and an upper housing forming a crank chamber internally accommodating a connecting portion that connects an eccentric part of the driveshaft and the movable part, and the upper housing having an upper bearing that pivotally supports the driveshaft below the crank chamber;

an oil supply passage leading oil in the oil retention space to the crank chamber, the oil supply passage being formed in the driveshaft;

an oil discharge passage including a main oil discharge passage that extends in an axial direction in the driveshaft, and a first inflow passage communicating between the main oil discharge passage and the crank chamber;

an oil supply pump configured to supply oil in the oil retention space to the oil supply passage; and an oil discharge pump configured to discharge oil in the crank chamber to the oil retention space via the oil discharge passage, an oil-recovery space being formed in a lower part of the upper housing below the crank chamber, the oil discharge passage further including a second inflow passage communicating between the main oil discharge passage and the oil-recovery space, an area of an inflow passage inlet of the first inflow passage is larger than an area of an inflow passage outlet of the first inflow passage, the inflow passage inlet opening into the crank chamber, and the inflow passage outlet opening into the main oil discharge passage, and the inflow passage inlet being disposed more forward in a rotation direction of the driveshaft than the inflow passage outlet.

11. The compressor according to claim 10, wherein the first inflow passage has an outlet-vicinity part that includes a straight part that extends, in a plan view, from the inflow passage outlet in a first direction, and in the plan view, a centroid of the inflow passage inlet is positioned on a forward side in the rotation direction relative to a first reference straight line that extends in the first direction from a centroid of the inflow passage outlet.

12. The compressor according to claim 10, wherein in the plan view, a centroid of the inflow passage inlet is positioned on a forward side in the rotation direction relative to a second reference straight line that extends from the rotation center of the driveshaft and passes through a centroid of the inflow passage outlet.

13. The compressor according to claim 10, further comprising a balance weight installed on the driveshaft in the crank chamber, the first inflow passage including an in-shaft inflow passage formed in the driveshaft and an in-weight inflow passage that is formed in the balance weight, communicates with the in-shaft inflow passage, and opens into the crank chamber.

14. The compressor according to claim 12, wherein the first inflow passage has a guide surface that extends in a direction intersecting the rotation direction, and in the plan view, the guide surface is parallel to the second reference straight line, or is disposed more forward in the rotation direction than the second reference straight line.

* * * * *